US012680440B2

(12) United States Patent
Jayalekshmi et al.

(10) Patent No.: US 12,680,440 B2
(45) Date of Patent: Jul. 14, 2026

(54) DRILLING OPERATIONS FRAMEWORK

(71) Applicant: Schlumberger Technology Corporation, Sugar Land, TX (US)

(72) Inventors: Sreelekshmi Jayalekshmi, Cambridge (GB); Sai Venkatakrishnan Sankaranarayanan, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/062,535

(22) Filed: Feb. 25, 2025

(65) Prior Publication Data

US 2025/0277437 A1 Sep. 4, 2025

Related U.S. Application Data

(60) Provisional application No. 63/560,290, filed on Mar. 1, 2024.

(51) Int. Cl.
*E21B 44/00* (2006.01)

(52) U.S. Cl.
CPC ..... *E21B 44/00* (2013.01); *E21B 2200/20* (2020.05); *E21B 2200/22* (2020.05)

(58) Field of Classification Search
CPC .. E21B 44/00; E21B 2200/20; E21B 2200/22; E21B 44/02
See application file for complete search history.

(56) References Cited

U.S. PATENT DOCUMENTS

| | | | | |
|---|---|---|---|---|
| 2018/0073348 | A1 | 3/2018 | Spoerker | |
| 2018/0171774 | A1* | 6/2018 | Ringer | E21B 47/002 |
| 2019/0178059 | A1* | 6/2019 | Zheng | E21B 47/00 |
| 2022/0082008 | A1* | 3/2022 | Koeneke | E21B 23/14 |
| 2023/0021393 | A1* | 1/2023 | Cai | G06F 30/17 |
| 2023/0039147 | A1* | 2/2023 | Gutarov | E21B 47/007 |
| 2024/0401471 | A1 | 12/2024 | Sankaranarayanan | |

OTHER PUBLICATIONS

Rasmussen, C. E., et al., "Gaussian Processes for Machine Learning", the MIT Press, ISBN 026218253X, 2006, p. 19.

* cited by examiner

*Primary Examiner* — Yanick A Akaragwe
(74) *Attorney, Agent, or Firm* — Kyle R. Miiller

(57) ABSTRACT

A method can include acquiring real-time data during rig operations that include rig operations for drilling a borehole in a subsurface geologic region using a drillstring that includes a drill bit, where the drillstring includes connected stands of drill pipe, and where the real-time data include a measured post-connection hook load value; predicting a post-connection hook load value using a trained model; estimating a post-connection hook load value using a filter that includes an input for the measured post-connection hook load value and an input for the predicted post-connection hook load value; and controlling drilling of the borehole based at least in part on the estimated post-connection hook load value.

18 Claims, 14 Drawing Sheets

DRILLING OPERATIONS FRAMEWORK

CROSS-REFERENCE TO RELATED APPLICATION(S)

The present disclosure claims priority from U.S. Provisional Appl. No. 63/560,290, filed on Mar. 1, 2024, herein incorporated by reference in its entirety.

BACKGROUND

A resource field may be an accumulation, pool or group of pools of one or more resources (e.g., oil, gas, oil and gas) in a subsurface environment. A resource field may include at least one reservoir. A reservoir may be shaped in a manner that may trap hydrocarbons and may be covered by an impermeable or sealing rock. A bore may be drilled into an environment where the bore may be utilized to form a well that may be utilized in producing hydrocarbons from a reservoir.

A rig may be a system of components that may be operated to form a bore in an environment, to transport equipment into and out of a bore in an environment, etc. As an example, a rig may include a system that may be used to drill a bore and to acquire information about an environment, about drilling, etc. A resource field may be an onshore field, an offshore field or an on- and offshore field. A rig may include components for performing operations onshore and/or offshore. A rig may be, for example, vessel-based, offshore platform-based, onshore, etc.

Field planning may occur over one or more phases, which may include an exploration phase that aims to identify and assess an environment (e.g., a prospect, a play, etc.), which may include drilling of one or more bores (e.g., one or more exploratory wells, etc.). Other phases may include appraisal, development and production phases.

SUMMARY

A method can include acquiring real-time data during rig operations that include rig operations for drilling a borehole in a subsurface geologic region using a drillstring that includes a drill bit, where the drillstring includes connected stands of drill pipe, and where the real-time data include a measured post-connection hook load value; predicting a post-connection hook load value using a trained model; estimating a post-connection hook load value using a filter that includes an input for the measured post-connection hook load value and an input for the predicted post-connection hook load value; and controlling drilling of the borehole based at least in part on the estimated post-connection hook load value. A system can include a processor; memory accessible by the processor; processor-executable instructions stored in the memory and executable to instruct the system to: acquire real-time data during rig operations that include rig operations for drilling a borehole in a subsurface geologic region using a drillstring that includes a drill bit, where the drillstring includes connected stands of drill pipe, and where the real-time data include a measured post-connection hook load value; predict a post-connection hook load value using a trained model; estimate a post-connection hook load value using a filter that includes an input for the measured post-connection hook load value and an input for the predicted post-connection hook load value; and control drilling of the borehole based at least in part on the estimated post-connection hook load value. One or more computer-readable storage media may include processor-executable instructions to instruct a computing system to: acquire real-time data during rig operations that include rig operations for drilling a borehole in a subsurface geologic region using a drillstring that includes a drill bit, where the drillstring includes connected stands of drill pipe, and where the real-time data include a measured post-connection hook load value; predict a post-connection hook load value using a trained model; estimate a post-connection hook load value using a filter that includes an input for the measured post-connection hook load value and an input for the predicted post-connection hook load value; and control drilling of the borehole based at least in part on the estimated post-connection hook load value. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations may be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
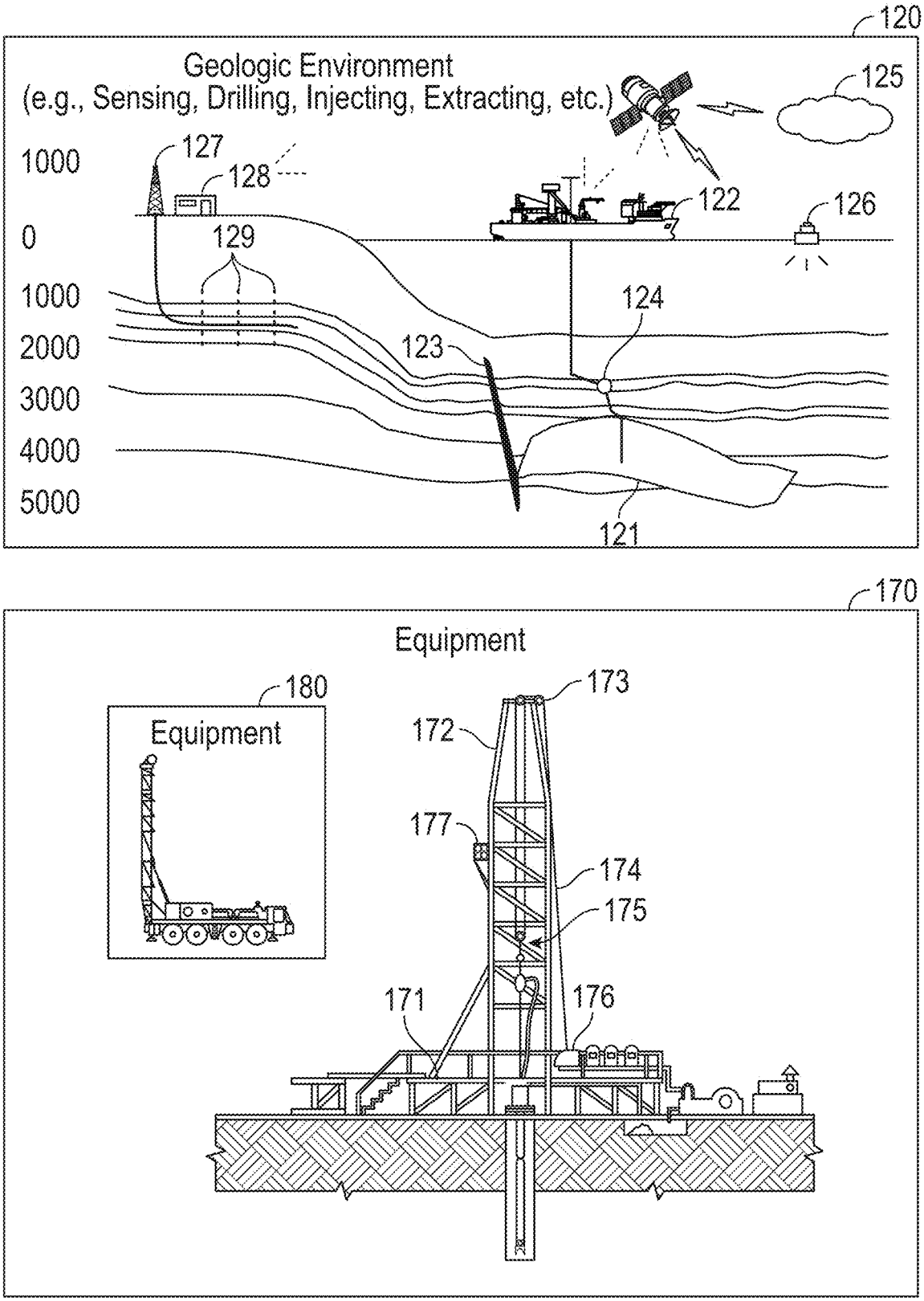
FIG. 1 illustrates examples of equipment in a geologic environment.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick may be a structure used to support a crown block and a traveling block operatively coupled to the crown block at least in part via line. A derrick may be pyramidal in shape and offer a suitable strength-to-weight ratio. A derrick may be movable as a unit or in a piece-by-piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line may cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block may include a set of pulleys (e.g., sheaves) that may be located at or near a top of a derrick or a mast, over which line is threaded. A traveling block may include a set of sheaves that may be moved up and down in a derrick or a mast via line threaded in the set of sheaves of the traveling block and in the set of sheaves of a crown block. A crown block, a traveling block and a line may form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick may include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until a time at which it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that may be pulled out of a hole and/or placed or replaced in a hole. As an example, a pipe trip may be performed where a drill bit has dulled or has otherwise ceased to drill efficiently and is to be replaced.

Figure 2:
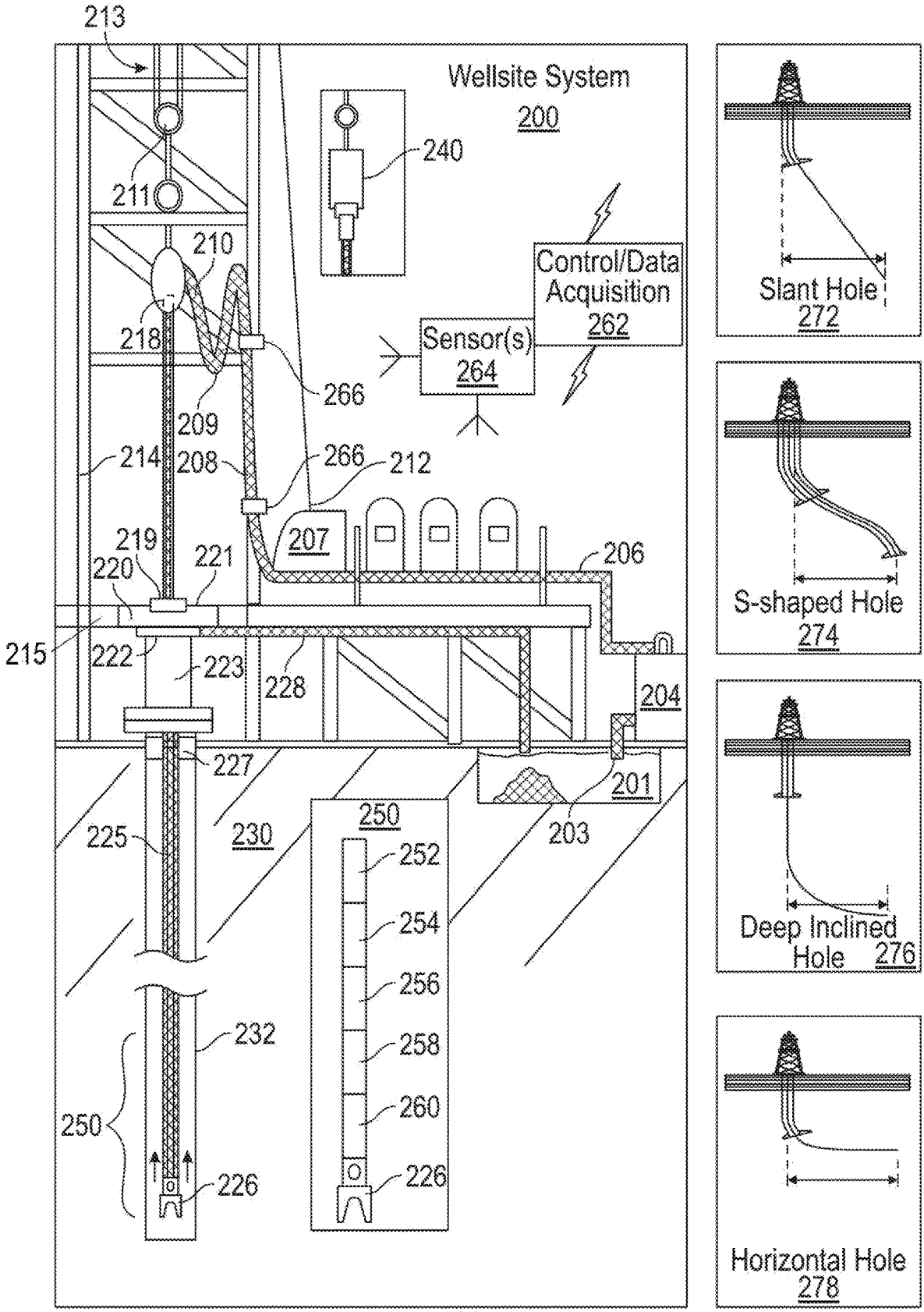
FIG. 2 illustrates examples of equipment and examples of hole types.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the platform 215 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may be modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254 (e.g., a LWD tool), a measuring-while-drilling (MWD) module 256 (e.g., a MWD tool), an optional module 258, a roto-steerable system (RSS) and/or motor 260, and the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface to drive a drill bit in a particular cutting direction. In such an example, a bit RPM may be determined or estimated based on the RPM of the mud motor. As an example, during a sliding mode, oscillation of a drillstring may be provided by surface equipment, for example, to oscillate the drillstring in a clockwise and a counterclockwise direction, which may, for example, help to reduce risk of sticking, etc.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools. It will also be understood that more than one LWD and/or MWD module may be employed. Where the position of a module is mentioned, as an example, it may refer to a module at the position of the LWD module 254, the MWD module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of one or more of an RSS, a downhole motor and/or a turbine. As to a motor, for example, a drillstring may include a positive displacement motor (PDM).

As an example, a system may be a steerable system and include equipment to perform a method such as geosteering. As an example, a steerable system may include a PDM or a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this term may refer to a portion of a drillstring that cannot be rotated or moved axially. As an example, a condition referred to as "differential sticking" may be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may be a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Various types of data associated with field operations may be 1-D series data. For example, consider data as to one or more of a drilling system, downhole states, formation attributes, and surface mechanics being measured as single or multi-channel time series data.

Figure 3:
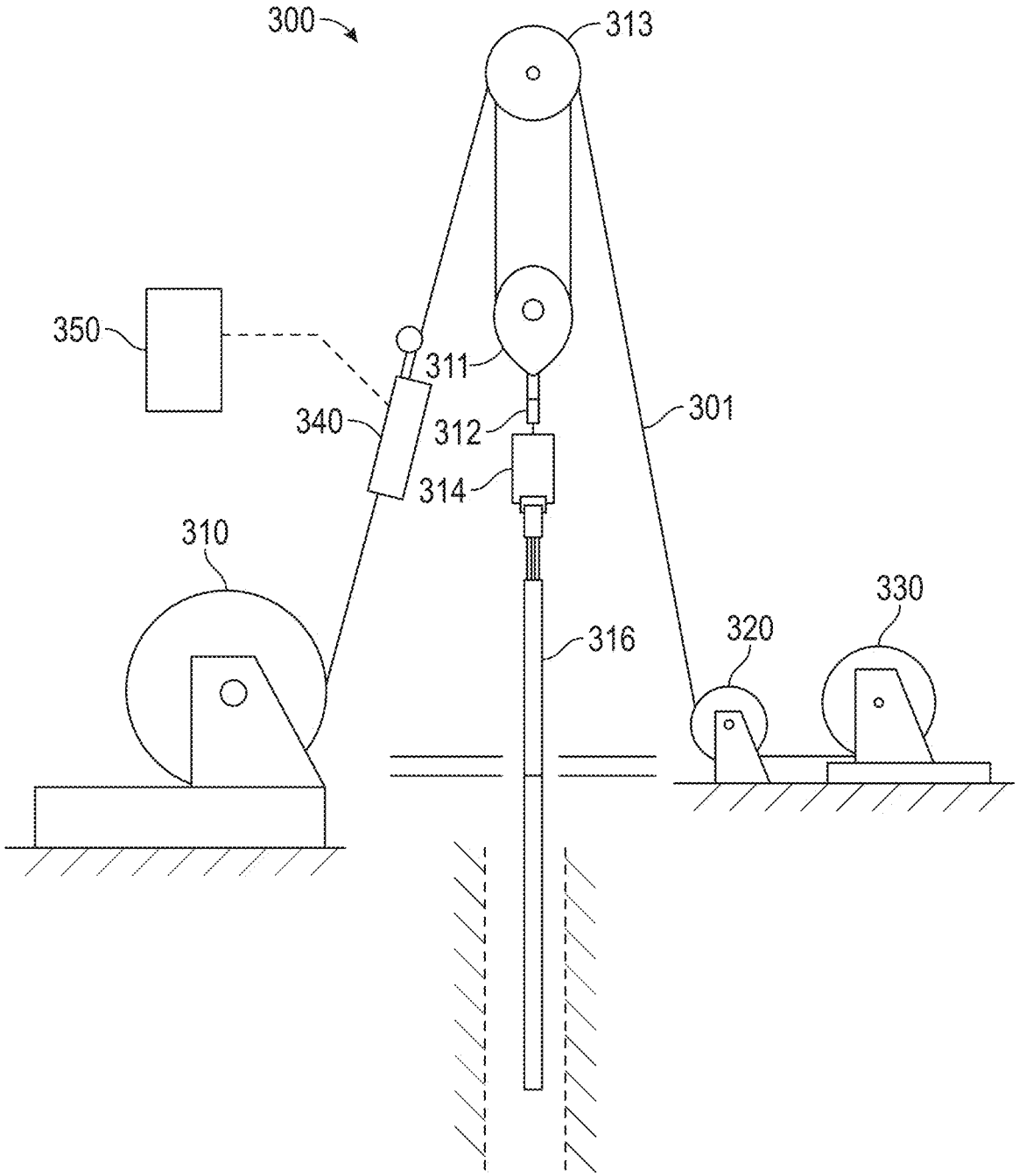
FIG. 3 illustrates an example of a system.

FIG. 3 shows an example of various components of a hoisting system 300, which includes a cable 301, a drawworks 310, a traveling block 311, a hook 312, a crown block 313, a top drive 314, a drillstring 316, a cable deadline tiedown anchor 320, a cable supply reel 330, one or more sensors 340 and circuitry 350 operatively coupled to the one or more sensors 340. In the example of FIG. 3, the hoisting system 300 may include various sensors, which may include one or more of load sensors, displacement sensors, accelerometers, etc. As an example, the cable deadline tiedown anchor 320 may be fit with a load cell (e.g., a load sensor).

The hoisting system 300 may be part of a wellsite system (see, e.g., FIG. 1 and FIG. 2). In such a system, a measurement channel may be a block position measurement channel, referred to as BPOS, which provides measurements of a height of a traveling block, which may be defined about a deadpoint (e.g., zero point) and may have deviations from that deadpoint in positive and/or negative directions. For example, consider a traveling block that may move in a range of approximately −5 meters to +45 meters, for a total excursion of approximately 50 meters. As an example, a null point or deadpoint may be defined to make a scale positive, negative or both positive and negative. In such an example, a rig height may be greater than approximately 50 meters (e.g., a crown block may be set at a height from the ground or rig floor in excess of approximately 50 meters). While various examples are given for land-based field operations (e.g., fixed, truck-based, etc.), various methods may apply for marine-based operations (e.g., vessel-based rigs, platform rigs, etc.).

As to the distance range of a traveling block, it may be sufficient for adding and removing drill pipe and/or other components. As an example, a stand may be two or three single joints of drill pipe or drill collars that remain screwed together during tripping operations. As an example, a stand may be a three-joint stand. As an example, a drill pipe length may be approximately 10 m (e.g., consider from about 27 ft to about 30 ft); noting that shorter or longer drill pipe may be utilized. Where a stand is composed of three lengths of approximately 10 m drill pipe, the stand may have an over length of approximately 30 m (e.g., approximately 100 ft). As such, a traveling block that has a total excursion of approximately 50 m may be raised and lowered to accommodate a stand of approximately 30 m (e.g., for addition to a drillstring or removal from a drillstring).

BPOS is a type of real-time channel that reflects surface mechanical properties of a rig. Another example of a channel is hook load, which may be referred to as HKLD. HKLD may be a 1-D series measurement of the load of a hook. As to a derivative, a first derivative may be a load velocity and a second derivative may be a load acceleration. Such data channels may be utilized to infer and monitor various operations and/or conditions. In some examples, a rig may be represented as being in one or more states, which may be referred to as rig states.

As to the HKLD channel, it may help to detect if a rig is "in slips", while the BPOS channel may be a primary channel for depth tracking during drilling. For example, BPOS may be utilized to determine a measured depth in a geologic environment (e.g., a borehole being drilled, etc.). As to the condition or state "in slips", HKLD is at a much lower value than in the condition or state "out of slips".

The term slips refers to a device or assembly that may be used to grip a drillstring (e.g., drill collar, drill pipe, etc.) in a relatively non-damaging manner and suspend it in a rotary table. Slips may include three or more steel wedges that are hinged together, forming a near circle around a drill pipe. On the drill pipe side (inside surface), the slips are fitted with replaceable, hardened tool steel teeth that embed slightly into the side of the pipe. The outsides of the slips are tapered to match the taper of the rotary table. After the rig crew places the slips around the drill pipe and in the rotary, a driller may control a rig to slowly lower the drillstring. As the teeth on the inside of the slips grip the pipe, the slips are pulled down. This downward force pulls the outer wedges down, providing a compressive force inward on the drill pipe and effectively locking components together. Then the rig crew may unscrew the upper portion of the drillstring (e.g., a kelly, saver sub, a joint or stand of pipe) while the lower part is suspended. After some other component is screwed onto the lower part of the drillstring, the driller raises the drillstring to unlock the gripping action of the slips, and a rig crew may remove the slips from the rotary.

A hook load sensor may be used to measure a weight of load on a drillstring and may be used to detect whether a drillstring is in-slips or out-of-slips. When the drillstring is in-slips, motion from the blocks or motion compensator do not have an effect on the depth of a drill bit at the end of the drillstring (e.g., it will tend to remain stationary). Where movement of a traveling block is via a drawworks encoder (DWE), which may be mounted on a shaft of the drawworks, acquired DWE information (e.g., BPOS) will not augment the recorded drill bit depth. When a drillstring is out-of-slips (e.g., drilling ahead), DWE information (e.g., BPOS) may augment the recorded bit depth. The difference in hook load weight (HKLD) between in-slips and out-of-slips tends to be distinguishable. As to marine operations, heave of a vessel may affect bit depth whether a drillstring is in-slips or out-of-slips. As an example, a vessel may include one or more heave sensors, which may sense data that may be recorded as 1-D series data.

As to marine operations, a vessel may experience various types of motion, such as, for example, one or more of heave, sway and surge. Heave is a linear vertical (up/down) motion, sway is linear lateral (side-to-side or port-starboard) motion, and surge is linear longitudinal (front/back or bow/stern) motion imparted by maritime conditions. As an example, a vessel may include one or more heave sensors, one or more sway sensors and/or one or more surge sensors, each of which may sense data that may be recorded as 1-D series data.

As an example, BPOS alone, or combined with one or more other channels, may be used to detect whether a rig is "on bottom" drilling or "tripping", etc. An inferred state may be further consumed by one or more systems such as, for example, an automatic drilling control system, which may be a dynamic field operations system or a part thereof. In such an example, the conditions, operations, states, etc., as discerned from BPOS and/or other channel data may be predicates to making one or more drilling decisions, which may include one or more control decisions (e.g., of a controller that is operatively coupled to one or more pieces of field equipment, etc.).

A block may be a set of pulleys used to gain mechanical advantage in lifting or dragging heavy objects. There may be two blocks on a drilling rig, the crown block and the traveling block. Each may include several sheaves that are rigged with steel drilling cable or line such that the traveling block may be raised (or lowered) by reeling in (or out) a spool of drilling line on the drawworks. As such, block position may refer to the position of the traveling block, which may vary with respect to time. FIG. 1 shows the traveling block assembly 175, FIG. 2 shows the traveling block 211 and FIG. 3 shows the traveling block 311.

A hook may be high-capacity J-shaped equipment used to hang various equipment such as a swivel and kelly, elevator bails, or a topdrive. FIG. 3 shows the hook 312 as operatively coupled to a top drive 314. As shown in FIG. 2, a hook may be attached to the bottom of the traveling block 211 (e.g., part of the traveling block assembly 175 of FIG. 1). A hook may provide a way to pick up heavy loads with a traveling block. The hook may be either locked (e.g., a normal condition) or free to rotate, so that it may be mated or decoupled with items positioned around the rig floor, etc.

Hook load may be the total force pulling down on a hook as carried by a traveling block. The total force includes the weight of the drillstring in air, the drill collars and ancillary equipment, reduced by forces that tend to reduce that weight. Some forces that might reduce the weight include friction along a bore wall (especially in deviated wells) and buoyant forces on a drillstring caused by its immersion in drilling fluid (e.g., and/or other fluid). If a blowout preventer (BOP) (e.g., or BOPs) is closed, pressure in a bore acting on cross-sectional area of a drillstring in the BOP may also exert an upward force.

A standpipe may be a rigid metal conduit that provides a high-pressure pathway for drilling fluid to travel approximately one-third of the way up the derrick, where it connects to a flexible high-pressure hose (e.g., kelly hose). A large rig may be fitted with more than one standpipe so that downtime is kept to a minimum if one standpipe demands repair. FIG. 2 shows the standpipe 208 as being a conduit for drilling fluid (e.g., drilling mud, etc.). Pressure of fluid within the standpipe 208 may be referred to as standpipe pressure.

As to surface torque, such a measurement may be provided by equipment at a rig site. As an example, one or more sensors may be utilized to measure surface torque, which may provide for direct and/or indirect measurement of surface torque associated with a drillstring. As an example, equipment may include a drill pipe torque measurement and controller system with one or more of analog frequency output and digital output. As an example, a torque sensor may be associated with a coupling that includes a resilient element operatively joining an input element and an output element where the resilient element allows the input and output elements to twist with respect to one another in response to torque being transmitted through the torque sensor where the twisting may be measured and used to determine the torque being transmitted. As an example, such a coupling may be located between a drive and drill pipe. As an example, torque may be determined via an inertia sensor or sensors. As an example, equipment at a rig site may include one or more sensors for measurement and/or determination of torque (e.g., in units of Nm, etc.).

As an example, equipment may include a real-time drilling service system that may provide data such as weight transfer information, torque transfer information, equivalent circulation density (ECD) information, downhole mechanical specific energy (DMSE) information, motion information (e.g., as to stall, stick-slip, etc.), bending information, vibrational amplitude information (e.g., axial, lateral and/or torsional), rate of penetration (ROP) information, pressure information, differential pressure information, flow information, etc. As an example, sensor information may include inclination, azimuth, total vertical depth, etc. As an example, a system may provide information as to whirl (e.g., backward whirl, etc.) and may optionally provide information such as one or more alerts (e.g., "severe backward whirl: stop and restart with lower surface RPM", etc.).

As to DMSE, it may be a MSE as associated with downhole energy. MSE may be utilized as a measure of drilling efficiency. MSE may be defined as the energy required to remove a unit volume of rock. For optimal drilling efficiency, field operations may aim to minimize the MSE and to maximize ROP. As an example, to control MSE, field equipment may be controlled as to factors such as, for example, one or more of WOB, torque, ROP and RPM.

A drill bit may be defined as a tool used to crush and/or cut rock. As explained, various rig equipment may directly and/or indirectly assist a drill bit in crushing and/or cutting the rock. Various drill bits may work by scraping or crushing the rock, or both, usually as part of a rotational motion; noting that some bits, known as hammer bits, pound rock. During drilling, various equipment may be controlled to deliver energy to a drill bit to crush and/or cut rock to thereby lengthen a borehole. As explained, drilling may aim to minimize MSE and maximize ROP while maintaining borehole quality (e.g., integrity, etc.). As an example, various equipment may be controlled as to energy delivered to a drillstring and/or a drill bit, for example, to address one or more conditions, which may include, for example, one or more conditions that may cause sticking of a drillstring and/or increase risk of sticking of a drillstring and/or one or more conditions involving actual sticking of a drillstring (e.g., getting a drillstring unstuck, etc.). As various physical interactions may occur between a drillstring and a formation (e.g., a borehole wall), controlled delivery of energy, material(s) (e.g., drilling fluid additives, etc.), etc., may provide for reduced risk of damage to the drillstring and/or the formation.

As explained, a drillstring may include a tool or tools that include various sensors that may make various measurements. For example, consider the OPTIDRILL tool (SLB, Houston, Texas), which includes strain gauges, accelerometers, magnetometer(s), gyroscope(s), etc. For example, such a tool may acquire weight on bit measurements (WOB) using a strain gauge (e.g., 10 second moving window with bandwidth of 200 Hz), torque measurements using a strain gauge (e.g., 10 second moving window with bandwidth of 200 Hz), bending moment using a strain gauge (e.g., 10 second moving window with bandwidth of 200 Hz), vibration using one or more accelerometers (e.g., 30 second RMS with bandwidth of 0.2 to 150 Hz), rotational speed using a magnetometer and a gyroscope (e.g., 30 second moving window with bandwidth of 4 Hz), annular and internal pressures using one or more strain gauges (e.g., 1 second average with bandwidth of 200 Hz), annular and internal temperatures using one or more temperature sensors (1 second average with bandwidth of 10 Hz), and continuous inclination using an accelerometer (30 second average with bandwidth of 10 Hz).

As mentioned, channels of real time drilling operation data may be received and characterized using generated synthetic data, which may be generated based at least in part on one or more operational parameters associated with the real time drilling operation. Such real time drilling operation data may include surface data and/or downhole data. As mentioned, data availability may differ temporally (e.g., frequency, gaps, etc.) and/or otherwise (e.g., resolution, etc.). Such data may differ as to noise level and/or noise characteristics. While various types of sensors are mentioned, equipment may be utilized that may not include one or more types of downhole sensors. In such instances, a method may be utilized that may determine one or more downhole values.

Figure 4:
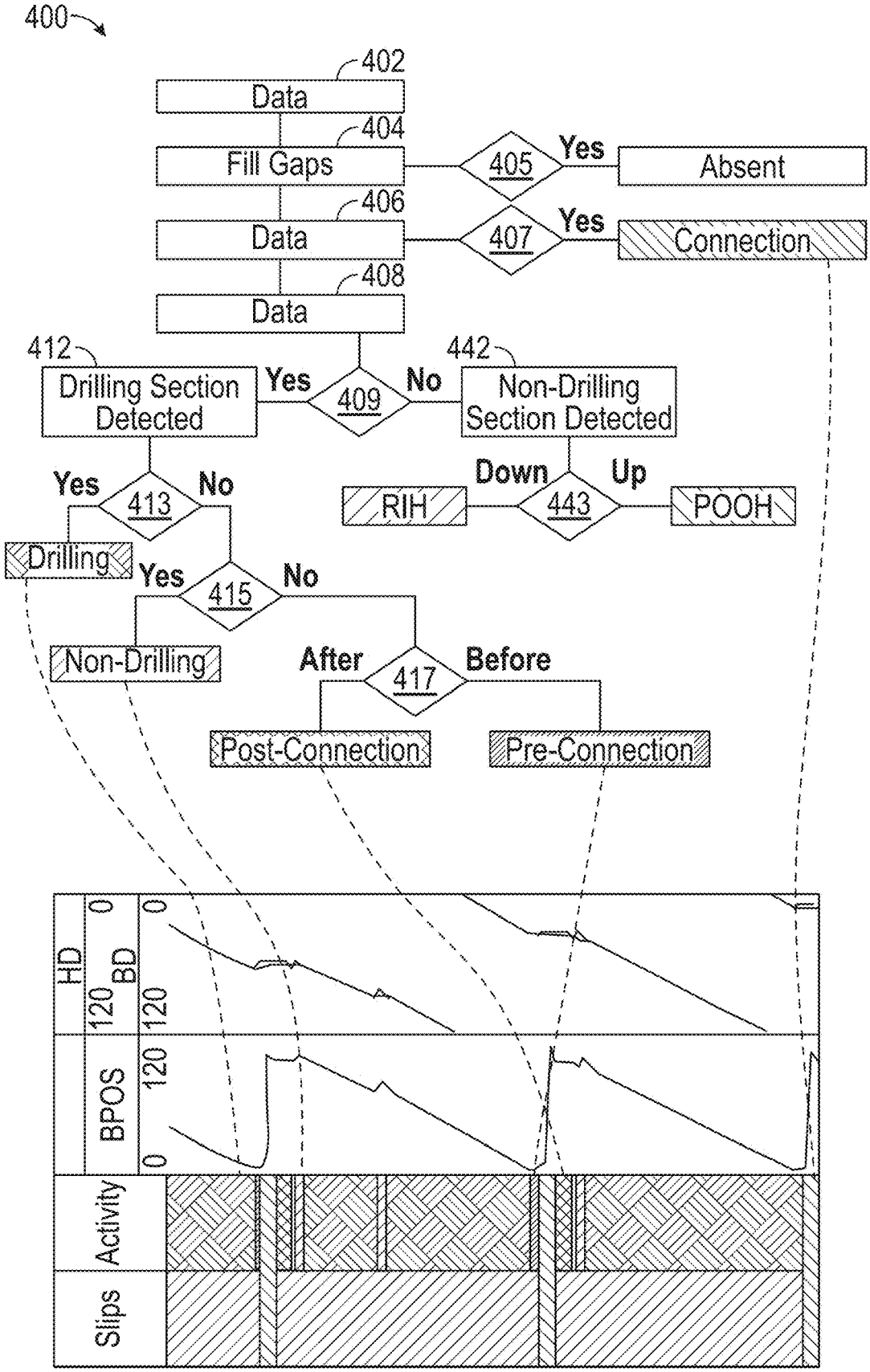
FIG. 4 illustrates an example of a method and an example of a graphic.

FIG. 4 shows an example of a method 400 that includes various blocks that may receive data, perform one or more analyses, perform one or more decisions, etc., to determine one or more states. In the example of FIG. 4, various examples of states may be illustrated with respect to shading, color, etc., for example, shading of various blocks may be utilized as a key for a graphical display (e.g., a graphical user interface), as shown in FIG. 4. In FIG. 4, the example states include drilling, non-drilling, run-in-hole (RIH), pull-out-of-hole (POOH), pre-connection, connection, post-connection, and absent.

In FIG. 4, drilling is drilling to increase the length of a wellbore. Non-drilling activity may be determined to be occurring when no other activities are occurring (e.g., drilling, RIH, POOH, pre-connection, connection, post-connection) and where the end of a current drill stand has not yet been reached. During non-drilling, the flow rate of fluid (e.g., mud) being pumped into a drillstring may increase and/or decrease, the rate of rotation of a drillstring may increase and/or decrease, a downhole tool (e.g., a drill bit) may move upwards and/or downwards, or a combination thereof. A non-drilling activity may be or include a time when a drill bit is idle (e.g., not drilling) and a slips assembly is not engaged with a drillstring.

Pre-connection may be where a downhole tool (e.g., a drill bit) has completed drilling operations for a current section of pipe, but the slips assembly has not begun to move (e.g., radially-inward) into engagement with the drillstring. During pre-connection, the flow rate of fluid being pumped into the drillstring may increase and/or decrease, the rate of rotation of the drillstring may increase and/or decrease, the downhole tool (e.g., the drill bit) may move upwards and/or downwards, or a combination thereof.

Connection may be where a slips assembly is engaged with, and supports, a drillstring (e.g., the drillstring is "in-slips"). When a connection is occurring, a segment (e.g., a pipe, a stand, etc.) may be added to the drillstring to increase the length of the drillstring, or a segment may be removed from the drillstring to reduce the length of the drillstring.

Post-connection may be where the drillstring is released by a slips assembly, and a downhole tool (e.g., the drill bit) are lowered to be on-bottom (e.g., bottom of hole or BOH). During post-connection, the flow rate of fluid being pumped into a drillstring may increase and/or decrease, the rate of rotation of a drillstring may increase and/or decrease, a downhole tool (e.g., the drill bit) may move upwards and/or downwards, or a combination thereof.

As to an absent state, it may indicate a scenario where data are not being received (e.g., at least one of a plurality of inputs is missing).

As an example, a method may be utilized to determine a slips status. For example, slips status may include one or more of the following: In-slips where a slips assembly is engaged with, and supports, a drillstring ("in-slips"); out-of-slips where the slips assembly is not engaged with, and is not supporting the drillstring; and absent where data is not received (e.g., at least one of the inputs is missing).

The method 400 of FIG. 4 may include various data acquisition or data reception blocks 402, 406, 408, etc., various decision block 405, 407, 409, 413, 415, 417, and 443, detection blocks 412 and 442 and state blocks. As an example, a block or blocks may provide for processing data, which may include real-time data. For example, a block 404 may provide for identifying one or more gaps and filling one or more of the one or more gaps (e.g., via interpolation, via insertion of data values indicative of missing values, etc.). As to the decision block 409, it may decide whether a drilling section is detected 412 or a non-drilling section is detected 442. For example, a drilling section may be indicative of a drilling state, a non-drilling state, a post-connection state, a pre-connection state, etc.; whereas, a non-drilling section may be indicative of a tripping operation such as, for example, RIH or POOH. As to the decision block 407, it may provide for detection of a connection state. As shown, various decision blocks may be implemented to detect a state.

As an example, in the method 400, measurements (e.g., data) may include a depth of a wellbore (e.g., a measured depth), a depth of a drill bit (e.g., a measured depth), a position of a travelling block (e.g., BPOS), or a combination thereof. A set of measurements may or may not include weight on hook (e.g., HKLD), or weight on a drill bit (e.g., WOB). Each set of measurements may be captured/received a predetermined amount of time after a previous set of measurements is captured/received. A predetermined amount of time may be, for example, about three seconds; however, the predetermined amount of time may be shorter or longer.

As an example, a method may be for determining a drilling activity that includes receiving a set of measurements at different times. The set of measurements may include a depth of a wellbore, a depth of a drill bit, and a position of a travelling block. Such a method may also include identifying a connection by determining when the position of the travelling block changes but the depth of the drill bit is not changing. Such a method may also include determining when the depth of the wellbore is not increasing between two different connections. Such a method may also include determining a direction that the drill bit moves between the two connections.

Figure 5:
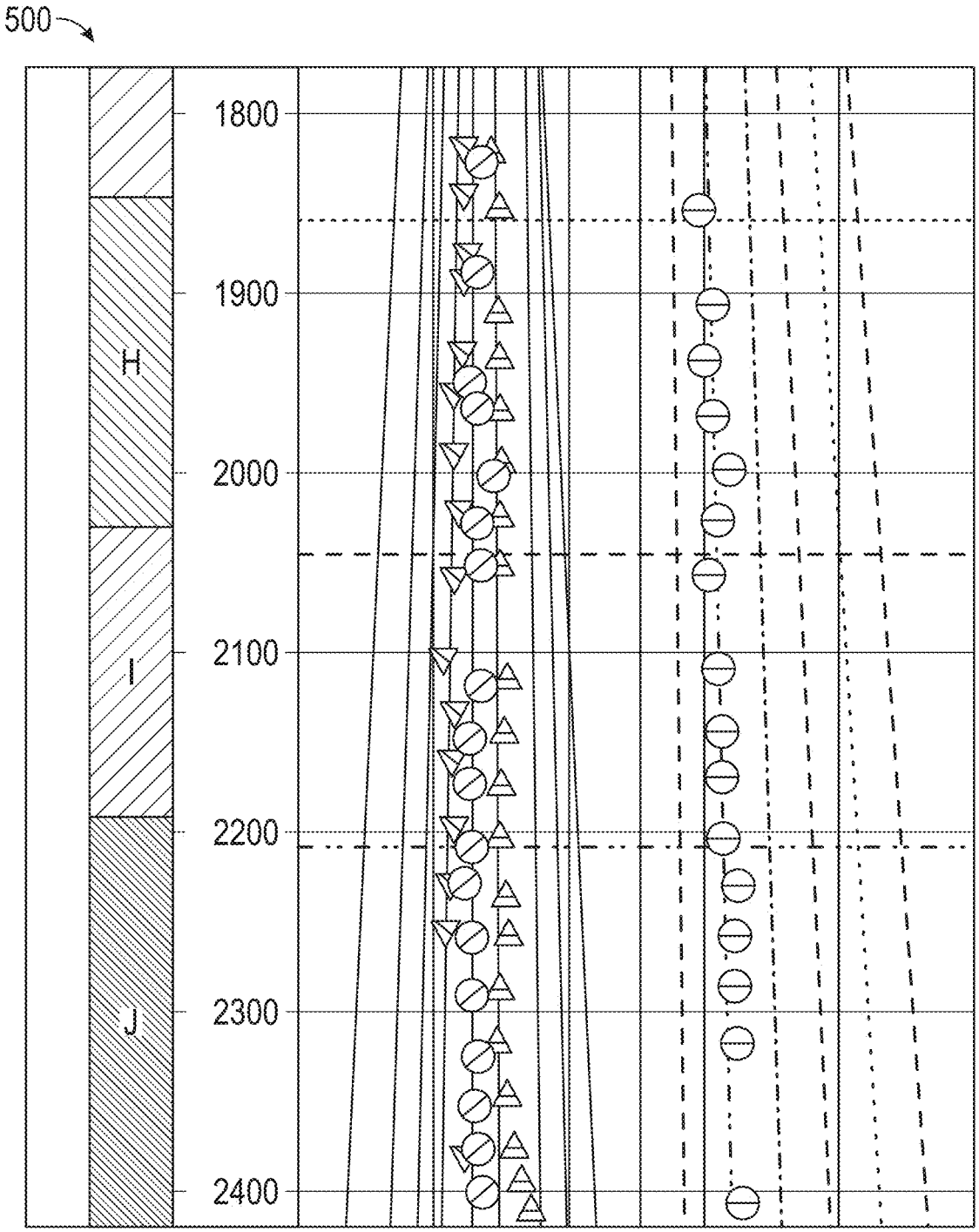
FIG. 5 illustrates an example of a graphical user interface.

FIG. 5 shows an example GUI 500 where comparisons may be made for pickup (PU) and slackoff (SO) weights taken during connections using a broomstick model. The example GUI 500 may render broomstick model plots with respect to depth (e.g., measured depth, etc.). Where a borehole is vertical, plotting with respect to depth may provide for some insight as the direction of the acceleration of gravity is vertical. Thus, an operator may understand how gravity impacts friction with respect to a drillstring, a BHA, a bit, drilling fluid (e.g., mud), etc. Further, pickup (PU) and slackoff (SO) may be with respect to gravity downhole, not just at surface.

As an example, a GUI may provide for rendering one or more broomstick model plots with respect to time (e.g., horizontally, vertically, etc.). In such an example, a broomstick model plot may be utilized to ascertain one or more friction factors with respect to time. As an example, a broomstick plot or broomstick model plot (e.g., a plot of model results, etc.), may be a full broomstick plot, a half broomstick plot or another portion of a broomstick plot. For example, where PU and SO are concerned, they may correspond to different directions such that a full broomstick plot may be generated; noting that a half broomstick plot for PU and/or a half broomstick plot for SO may be generated. As to TQLS, where the torque is in a particular rotational direction (e.g., a rotational direction of a bit for drilling), a broomstick plot may be a half broomstick plot; noting that torque may be acquired in two rotational directions (e.g., clockwise and counterclockwise), which may provide for rendering a plot in a full broomstick manner.

As an example, a system may provide for real-time (RT) torque and drag (T&D) monitoring. Abnormal torque and drag, which commonly refers to overpull, underpull, and high-torque load, are indications of excess frictional effects between the drillstring and the wellbore. Various conditions may cause these effects, including tight hole, differential sticking, poor hole cleaning, key seats, etc. Failing to detect these anomalies may cause excessive wear on a drillstring and may eventually lead to severe stuck pipe conditions.

As an example, a T&D workflow may be executed using surface sensor measurements and contextual data for extraction of information from relevant operations. Such information may then be used for modeling calibration and predictions, for example, based on a finite element method-based stiff-string T&D model. In such an approach, a T&D workflow may generate alarms, instructions, etc., based on one or more detected anomalies.

As an example, a workflow may use one or more physical models together with knowledge acquired from drilling data. A workflow may be fully automatic without demand for manual calibration and fixed thresholds. In such an example, the workflow may be adaptive to changing conditions of a well being drilled.

As explained, a rig system can include various sensors that can receive signals and convert the signals to digital data, which can be transmitted, for example, as a data stream. In such an example, a data stream can be a stream of real-time data. For example, as WOB changes during a drilling operation, the data stream can be a time series of data that includes values that vary over time correspondingly as the WOB varies. While WOB is mentioned, a data stream as time series data may be provided for HKLD too.

As an example, a sensor may provide for WOB and HKLD data (e.g., measurements). For example, consider a transducer that can measure tension of a wire-rope deadline that may span between a crown block sheave and a deadline anchor. In such an example, changes in tension may be converted to WOB and/or HKLD measurements. As an example, a transducer may utilize one or more types of circuitry, whether electronic and/or fluidic, to measure tension.

As an example, during various operations, tension on a drilling line may increase where, for example, hydraulic fluid may be forced through a gauge, turning the hands of an indicator of the gauge, generating a digital response, etc. In such an example, the weight that is measured tends to include substantially everything exerting tension on the drilling line, including the traveling block(s) and the drilling line itself. Hence, to have an accurate weight measurement of a drillstring, the driller can make a zero offset adjustment to account for the traveling block(s) and items other than the drillstring. With adjustments, the indicated weight will represent the drillstring (e.g., drill pipe and bottom hole assembly (BHA)).

During drilling operations, a driller may be interested in the measured weight for one or more operations. As mentioned, the weight of interest can be the weight applied to the bit on the bottom of the hole. As an example, a driller can take the rotating and hanging off bottom weight, say 136,200 kg, and subtract from that the amount of rotating on bottom weight, say 113,500 kg, to get a bit weight of 22,700 kg. Various rigs can include a weight indicator that has a second indicator dial that can be set to read zero ("zeroed") with the drillstring hanging free, where the second indicator dial works backwards from the main indicator dial. After proper zeroing, a weight set on bottom (that takes weight away from the main dial), has the effect of adding weight to this secondary dial, so that the driller can read weight on bit directly from the dial.

As may be appreciated, WOB can be approximate. Factors such as friction, fluid, debris, buoyancy, etc. can have effects on WOB measurements (e.g., as scalar values), stability of WOB measurements, etc. Hysteresis can exist such that WOB measurements differ depending on a direction of a drillstring moving in a hole. For example, moving in a direction of gravity may result in different time series data than moving in a direction contrary to gravity. Further, friction may differ depending on direction of movement.

As an example, a surface HKLD measurement can drop as soon as the bottom of the hole is engaged with the bit and the surface torque measurement can show an increased torque demand as the bit interacts with a formation (e.g., rock) and, if there is a downhole motor, surface pressure can increase, signaling an increase in differential pressure as the motor drills away. Such physical indicators can be present on the rig floor with relatively adequate fidelity and provide a sense of awareness for the driller that the equipment being operated is operating to crush through rock and make steady progress drilling ahead. The way a driller infers an operational state as being one of on or off bottom may be through experience and with some amount of uncertainty as one or more transition states can exist between the two states of on and off bottom; noting that one or more state detection systems may be implemented to determine or estimate a state such as being on bottom or being off bottom.

As explained, WOB measurements may be based on a difference in HKLD between off bottom and on bottom states. When a portion of a hanging drillstring weight is supported by a bit resting on the bottom of a borehole, HKLD is reduced by that portion. As an example, a difference between a current HKLD and a pre-set tare value (e.g., or TARE value) may be utilized as a reference for the amount of weight put on the bit. A TARE value may be obtained by measuring HKLD while suspending the drillstring in a borehole, and without the drillstring being supported on the bottom of the borehole. As drillstring weight changes as drill pipe segments are added to or removed from a drillstring, applying a designated WOB demands that the TARE weight be monitored. For example, consider the aforementioned zeroing approach where a gauge may include a secondary indicator that works backwards from a primary indicator (e.g., a main indicator) such that a driller may read WOB directly from the gauge.

As an example, a framework may provide for implementation of one or more automated methods that may be utilized for rig-based operations (e.g., drilling, etc.). As an example, a method can provide for detecting tare values for weight correction from a well construction process using one or more data-driven techniques. As an example, a method may provide for detecting a possible post-connection procedure for computing off bottom rotating weight from sensor data, which may include noise and/or artefacts, during a well construction process and combining that with a Gaussian process model to propose an optimal TARE value. In such an example, the method may also utilize information available in one or more pre-connection procedures to enhance reliability of a TARE value prediction.

As an example, a data-driven model may be generated using various types of data, which may include series data as time series data and/or depth series data. For example, consider a workflow that may utilize data for various operations at multiple rig sites that include measured depth (MD) data, inclination (Incl) data, and mud density data (e.g., mud weight data, given as mass per unit volume of a drilling fluid).

Figure 6:
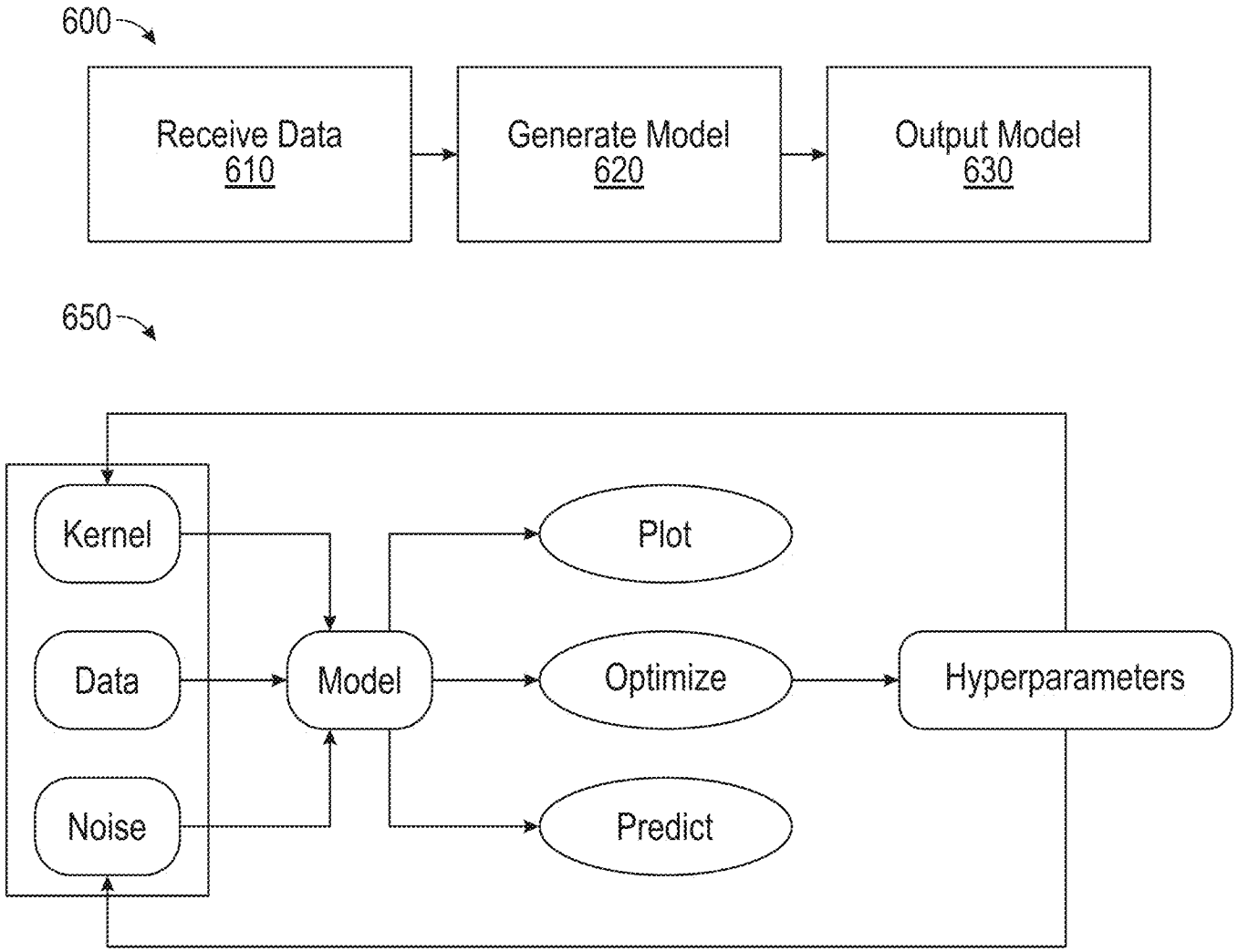
FIG. 6 illustrates an example of a method and an example of a model.

FIG. 6 shows an example of a method 600 that includes a reception block 610 for receiving data, a generation block 620 for generating a model, and an output block 630 for outputting a generated model. As an example, a model such as a Gaussian Process Regressor (GPR) may be utilized, which may also be referred to as a Gaussian Process Regression model (GPRM).

As an example, a GPR may be utilized, for example, via the scikit-learn framework, the GPy framework, etc. In the scikit-learn framework the GPR is an implementation based on Algorithm 2.1 of Gaussian Processes for Machine Learning (GPML) (C. E. Rasmussen & C. K. I. Williams, Gaussian Processes for Machine Learning, the MIT Press, 2006, ISBN 026218253X, at p. 19), which is incorporated by reference herein. In addition to standard scikit-learn estimator API, GPR: allows prediction without prior fitting (based on the GP prior); provides an additional method sample_y (X), which evaluates samples drawn from the GPR (prior or posterior) at given inputs; exposes a method log_marginal_likelihood (theta), which can be used externally for other ways of selecting hyperparameters, e.g., via Markov chain Monte Carlo.

---

Algorithm 2.1 of GPML for GPR input: X(inputs), y(targets), k(covariance function), $\sigma_n^2$(noise level), x*(test)

2: $L := \text{cholesky}(K + \sigma_n^2 I)$ $\alpha := L^T \backslash (L \backslash y)$ 4: $f^* := k^{*T}\alpha$ $v := L \backslash k^*$ 6: $V[f^*] := k(x^*, x^*) - v^T v$ $\log p(y|X) := -(1/2)y^T\alpha - \Sigma_i \log L_{ii} - (n/2)\log 2\pi$ 8: return: f*(mean), V[f*](variance), log p(y|X)(log marg. likelihood)

---

Algorithm 2.1 provides for predictions and log marginal likelihood for GPR. The implementation addresses the matrix inversion required in lines 3 and 4 using Cholesky factorization in lines 5 and 6. For multiple test cases lines 4-6 can be repeated. The log determinant required in line 7 can be computed from the Cholesky factor (noting that for large n it may not be possible to represent the determinant itself). The computational complexity is $n^3/6$ for the Cholesky decomposition in line 2, and $n^2/2$ for solving triangular systems in line 3 and (for each test case) in line 5. Algorithm 2.1 uses Cholesky decomposition, instead of directly inverting the matrix, as it can be faster and numerically more stable. The algorithm returns the predictive mean and variance for noise free test data where, for example, to compute the predictive distribution for noisy test data, the algorithm can include adding the noise variance to the predictive variance.

As to the GPy library, consider the model 650 of FIG. 6, where a kernel, data, and noise may be fed into a GPRM to generate output that may be optimized via use of one or more hyperparameters, which may feedback into tuning of how a kernel and/or noise are handled. In the GPy library, a kernel (GPy.kern), data and, optionally, a representation of noise may be assigned to the GPRM. Tailored models may demand, or may make use of, one or more types of additional information. As indicated, a kernel and/or noise may be controlled via hyperparameters, for example, by calling one or more optimization techniques (e.g., GPy.core.gp.GP.optimize) to be applied against the model to invoke an iterative process that may seek optimal hyperparameter values. As shown in the example of FIG. 6, the model (e.g., as an object), may be implemented to make plots and/or predictions.

Gaussian Processes (GP) are a generic supervised learning method designed to solve regression and probabilistic classification problems. Some example advantages of Gaussian processes are: the prediction interpolates the observations (at least for regular kernels); the prediction is probabilistic (Gaussian) so that one can compute empirical confidence intervals and decide based on those if one should refit (online fitting, adaptive fitting) the prediction in some region of interest; versatility in that different kernels can be specified (e.g., common kernels can be provided where it is also possible to specify custom kernels).

A GPR can implement one or more GPs for regression purposes. For this, the prior of the GP can be specified. The prior mean can be assumed to be constant and zero (for normalize_y=False) or the training data's mean (for normalize_y=True). The prior's covariance can be specified by passing a kernel object. The hyperparameters of the kernel can be optimized during fitting of GPR by maximizing the log-marginal-likelihood (LML) based on the passed optimizer. As the LML may have multiple local optima, the optimizer can be started repeatedly by specifying n_restarts_optimizer. As an example, a first run may be conducted starting from an initial set of hyperparameter values of a kernel; where subsequent runs can be conducted from hyperparameter values that have been chosen randomly from the range of allowed values. If the initial hyperparameters are to be kept fixed, none can be passed as optimizer.

As an example, noise level in the targets can be specified by passing it via the parameter alpha, either globally as a scalar or per datapoint. Note that a moderate noise level can also be helpful for dealing with numeric issues during fitting as it is effectively implemented as Tikhonov regularization, e.g., by adding it to the diagonal of the kernel matrix. As an example, an alternative to specifying the noise level explicitly is to include a WhiteKernel component into the kernel, which can estimate the global noise level from the data.

The form of the mean function and covariance kernel function in a GP prior may be chosen and tuned during model selection. The mean function may be constant, either zero or the mean of a training dataset. Various options exist for the covariance kernel function, which may be semi-positive definite and symmetric. Some kernel functions may include constant, linear, square exponential and Matern kernel, as well as a composition of multiple kernels. One example of a kernel is the composition of the constant kernel with the radial basis function (RBF) kernel, which encodes for smoothness of functions. Such a kernel has two hyperparameters: signal variance, $\sigma^2$, and lengthscale, l. In the scikit-learn framework, a variety of kernels are available and it is possible to specify the initial value and bounds on the hyperparameters.

As an example, an approach to tune the hyperparameters of the covariance kernel function can involve maximizing the log marginal likelihood of the training data. For example, a gradient-based optimizer may be used for efficiency; if unspecified above, a default optimizer in the scikit-learn framework is fmin_l_bfgs_b. As the log marginal likelihood is not necessarily convex, multiple restarts of the optimizer with different initializations may be used (n_restarts_optimizer).

As mentioned, a model may be utilized that includes various inputs such as, for example, MD, INCL, and mud density. In such an example, output may be HKLD during free rotation with mud pumps running (e.g., flow or FLWI being greater than zero). For example, the method 600 of FIG. 6 may include accessing data from one or more databases and generating a trained model using the data as training and/or testing data. In such an example, a trained model may be output that can be implemented prior to an operation, during an operation, after an operation, etc. For example, prior to an operation, if MD, INCL, and mud density are known, these may be input for a number of different MD values to generate estimates of HKLD during free rotation with mud pumps running for the different MD values (e.g., values along a borehole trajectory). As to during an operation, a trained model may be implemented incrementally, for example, as a length of drill pipe is added or removed. As to after an operation, a trained model may be implemented to assess the operation or operations, for example, to determine whether one or more standard operating procedures were suitably performed or not.

As explained, a framework may utilize a data-driven model to provide for a predicted HKLD value, which may be utilized for appropriate computation of a TARE value, as an off bottom rotating weight for a drillstring with pumps on (e.g., mud circulating such that FLWI is greater than zero). Such a TARE value may be beneficial for well construction operations both in terms of safety and efficiency.

As an example, a framework may provide for use of one or more sensor-based measurements and/or one or more model-based predictions. For example, consider an approach that may act to output a TARE value based on both a measurement of HKLD and a prediction of HKLD. In such an example, the framework may implement a type of probabilistic filter that can determine how to combine a measurement and a prediction.

Figure 7:
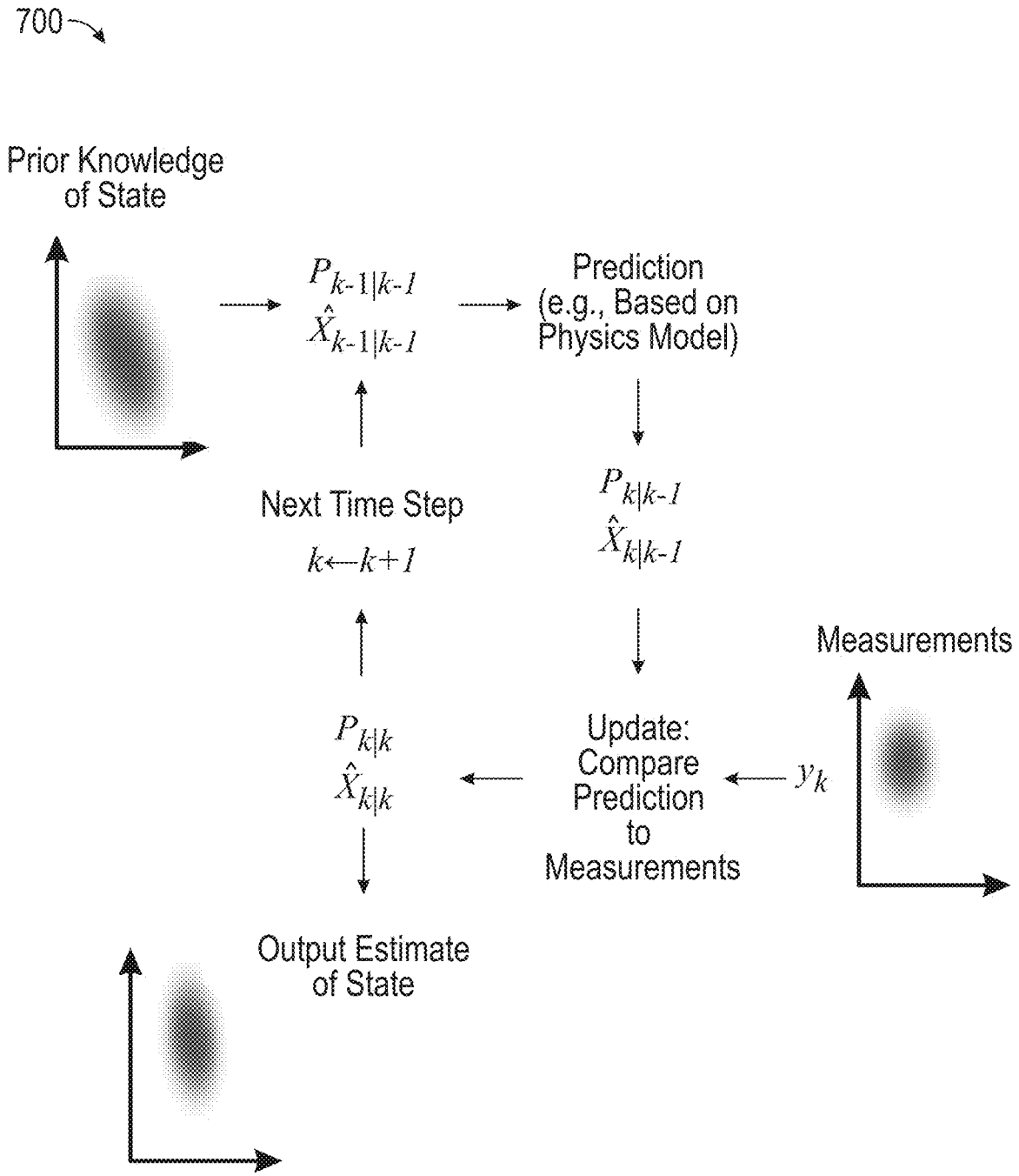
FIG. 7 illustrates an example of a method.

FIG. 7 shows an example of a filter 700 (e.g., a probabilistic filter) that may be implemented by a framework. As shown, the filter 700 may be a type of Kalman filter that utilizes a Bayesian approach. In such an example, the filter 700 may be implemented to output a best estimate of a TARE value, which may be performed iteratively for each stand of drill pipe, for example, on demand by combining surface sensor data to detect possible off bottom weight during post-connection periods as measurement with a data-driven model for prediction (e.g., a GPRM). To extract maximum information from data, a pre-connection period may also be analyzed for each stand of drill pipe to construct a possible prior for a post-connection of an upcoming stand of drill pipe.

In the example of FIG. 7, the filter 700 is shown as a Kalman filter that includes a prediction process and an update process, where the update is based on measurements and output of the prediction process. The update process provides for output of a state estimate as well as feedback (e.g., recursion) for the prediction process at a subsequent iteration (e.g., a next time increment). As indicated, prior knowledge of a state can be an input that is used in combination with output of the update process by the prediction process. As indicated, the prediction process may be based on a model of a system (e.g., a dynamic system), which, as explained, may be a data-driven model and/or a hybrid physics-based and data-driven model. As explained, a data-driven model may be a Gaussian Process type of model such as, for example, a GPRM.

In statistics and control theory, Kalman filtering, also known as linear quadratic estimation (LQE), is a technique that uses a series of measurements observed over time, which may include statistical noise and/or other inaccuracies, producing estimates of unknown variables that tend to be more accurate than those based on a single measurement alone. This may be achieved by estimating a joint probability distribution over the variables for each timeframe.

A Kalman filter may be applied to understand the behavior of a system that changes or evolves over time. A Kalman filter may be utilized in scenarios where information may include uncertainties (e.g., statistical noise and/or other inaccuracies) about a current state of a system under consideration, to estimate information about what the system is going to look like in the future (e.g., in a next state). By capturing certain correlations in the processes pertaining to that system based on its current state, $t=k-1$, it may be possible to generate a reasonably accurate estimation regarding the next state, k.

As explained, a filter may be a Bayesian type of filter that may be implemented to combine output of a prediction model with a measurement for TARE value estimation. As explained, a prediction model may include conditioning a data-driven GP modelled for a given depth (e.g., MD). As explained, measured depth, mud density and inclination may be the predictor variables of the model and the off-bottom weight on a drillstring may be the response.

Figure 8:
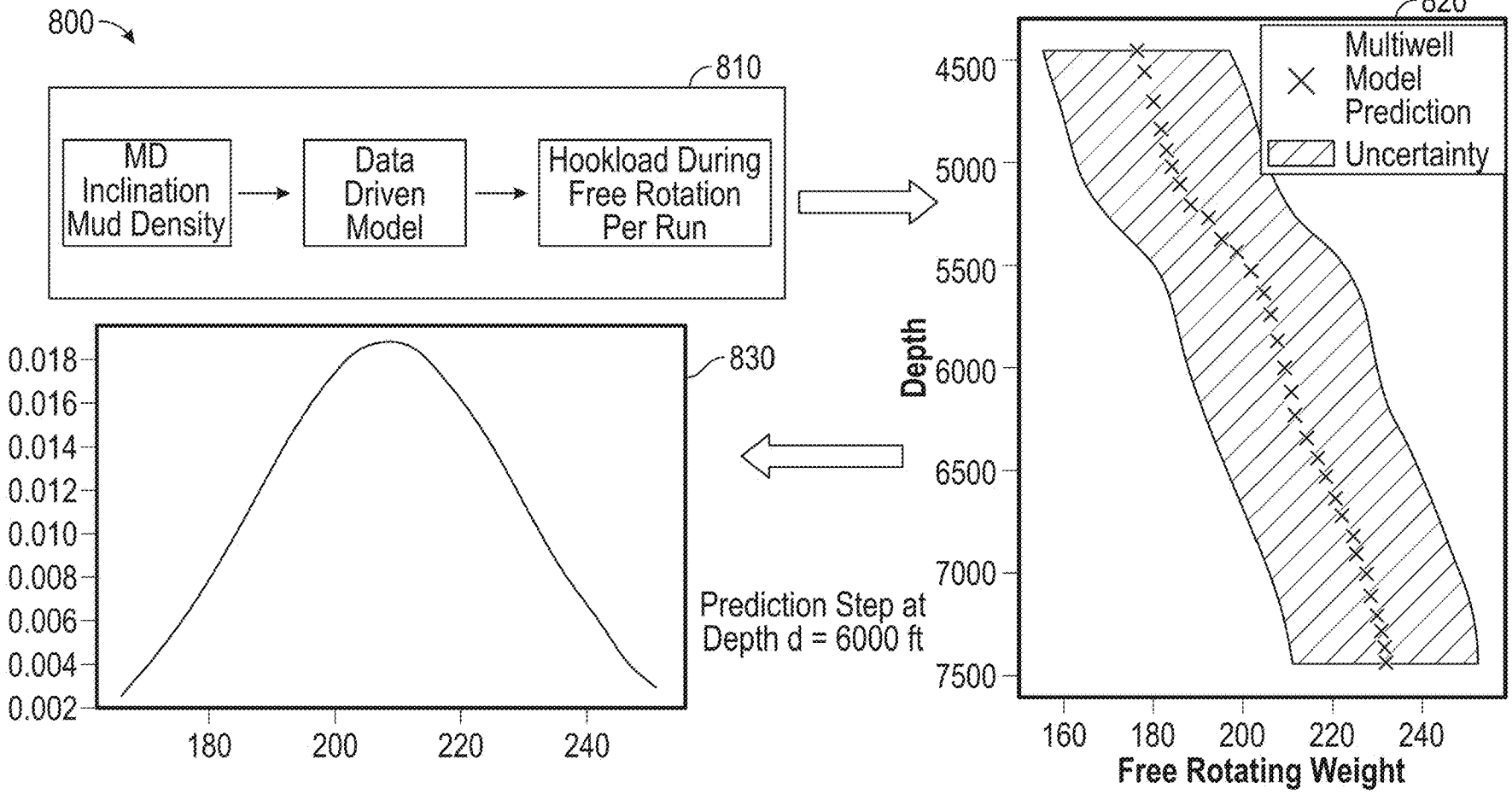
FIG. 8 illustrates an example of a framework processes.

FIG. 8 shows an example of framework processes 800, for example, as a prediction design framework conditioning TARE on MD=6000 ft (e.g., d=6000 ft), mud weight and inclination. As shown, a prediction process 810 can predict HKLD during free rotation per run, which may provide for multiwell-based predictions along with uncertainty as to free rotating weight for a number of depths (e.g., ranging from approximately 4500 feet to approximately 7500 feet), as shown in a plot 820. As mentioned, for MD equal to 6000 ft, a slice through the plot 820 provides a Gaussian distribution for free rotating weight as shown in a plot 830 where a mean value may correspond to the highest probable value (e.g., for TARE value estimation).

As an example, a measurement action may pertain to detecting the phase in post-connection where a possible off bottom measurement can be identified to be used. This action is not always possible as its corresponding state may be merely inferred as a side effect of operations happening on a rig without a planned operation such that it may not always be possible to identify a suitable off bottom weight in all post-connection operations. In various instance, particularly with sparse post-connection measurements, a prediction process may be implemented, for example, to augment the prediction of TARE values.

Figure 9:
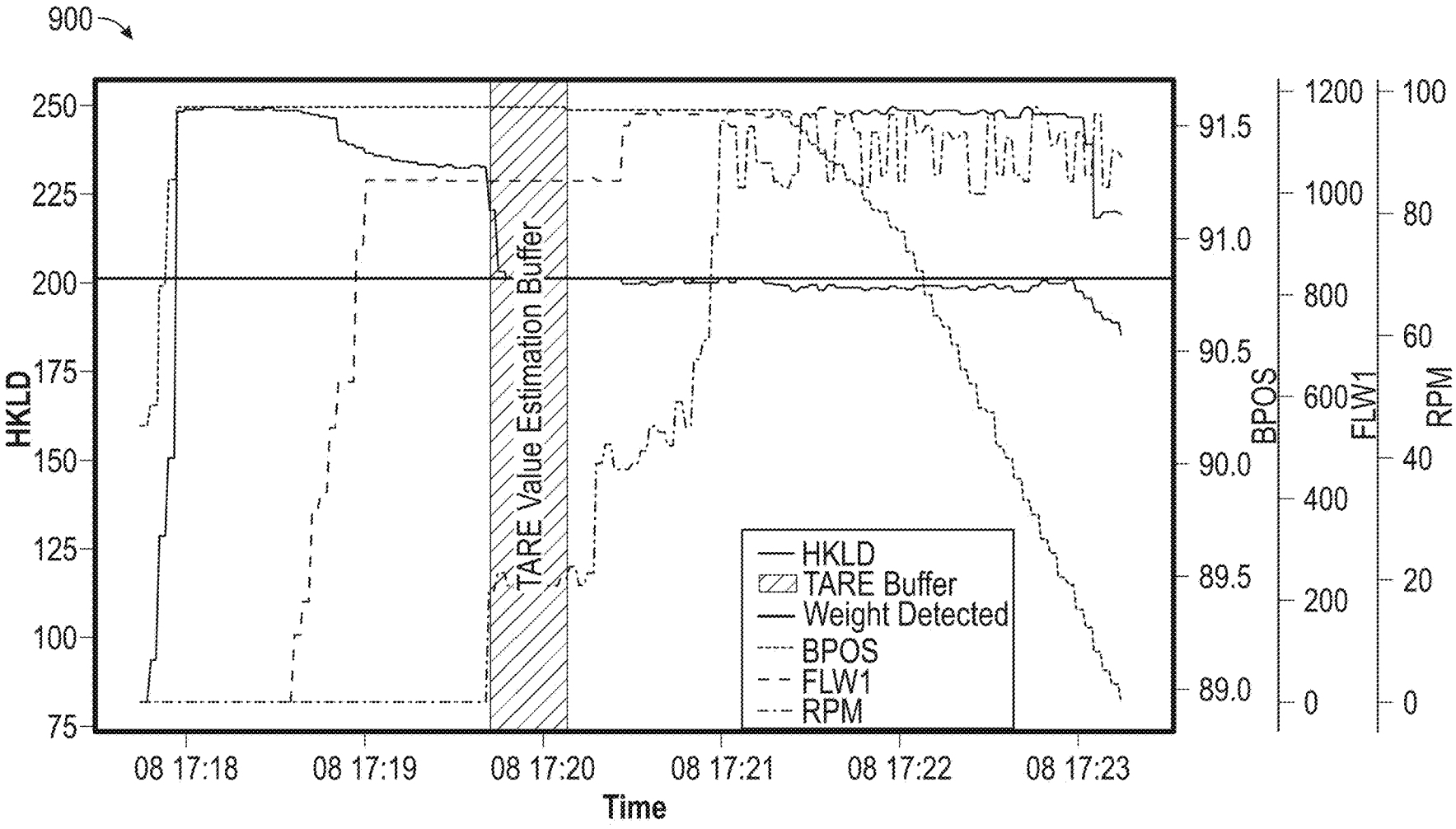
FIG. 9 illustrates an example of a graphical user interface.

FIG. 9 shows an example of graphical user interface (GUI) 900 that includes various data with respect to time, including HKLD, detected weight, BPOS, FLWI and RPM. As explained, a model-based framework may operate using various types of data. For example, FLWI may indicate whether flow exists or not (e.g., mud pumps on or not, etc.) and RPM may indicate whether a drillstring is being rotated or not (e.g., from surface by a top drive, etc.). As explained, a relevant state of interest may be for a drillstring being off bottom and rotating with mud circulating. Hence, one or more of the types of data in the GUI 900 may be utilized to detect and/or infer one or more states. As shown in the GUI 900, a certain time window (e.g., period or span of time) is indicated as being associated with a TARE value estimation buffer. As an example, a framework may provide for identifying a possible time window (e.g., location in time series data) of weight collection and TARE computation from a post-connection process, for example, at a measured depth of 6000 ft (see, e.g., FIG. 8).

In the example of FIG. 9, the time window (e.g., buffer) is relatively short (e.g., less than 1 second); noting that a window (e.g., a buffer) may have a span that may dynamically change in a manner that depends on operations (e.g., how fast or slow one or more operations may be performed). In the indicated window (e.g., buffer), HKLD is shown to be decreasing and then leveling off to a substantially constant value. In particular, HKLD is dropping from approximately 220 to approximately 200 within the window (e.g., buffer). As an example, a window (e.g., buffer) may provide for detection of such a drop in HKLD, which may be associated with, for example, a rise in RPM where, for example, BPOS and FLWI may be relatively constant. As shown, FLWI ramps up prior to the window (e.g., buffer), which may be accompanied by some amount of decrease in HKLD where upon ramping up of RPM, a further decrease in HKLD may be experienced followed by a leveling off of HKLD even where there may be some amount of variation in RPM. As shown in the example of FIG. 9, both RPM and FLWI may be increased at some point in time after the window (e.g., buffer) where a decrease in BPOS may follow to engage a drill bit and formation rock for drilling that may lengthen a borehole.

Figure 10:
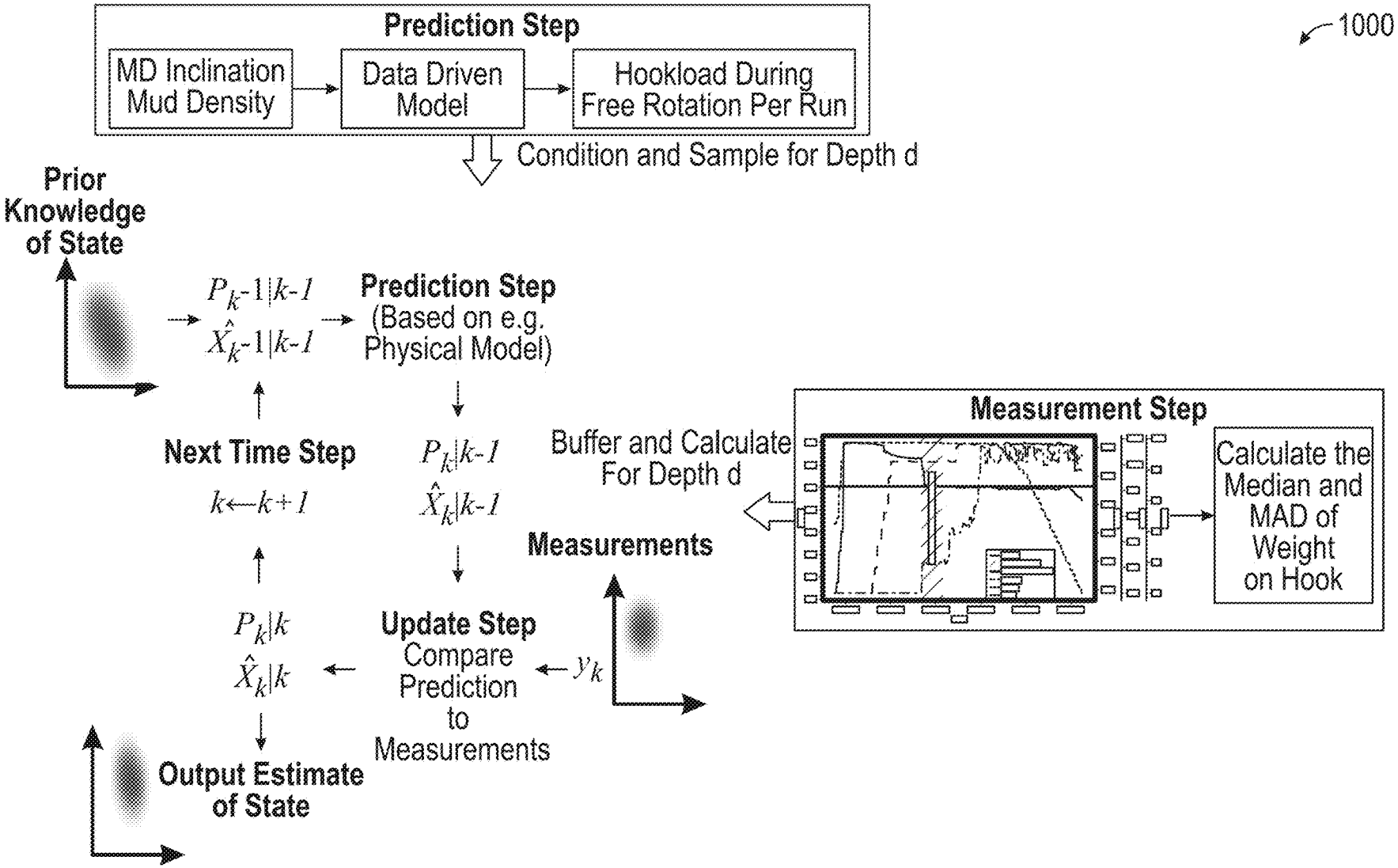
FIG. 10 illustrates an example of a framework processes.

FIG. 10 shows an example method 1000 that may be implemented by a framework where a Bayesian type of filter utilizes a measurement and a prediction, which may be implemented for one or more depths of a drillstring in a borehole. As shown, for a particular depth, the method 1000 may include predicting and measuring where measuring may be accompanied with computing a median and a mean absolute deviation (MAD) of weight on hook, which may be based on data within a window or buffer, etc.

Figure 11:
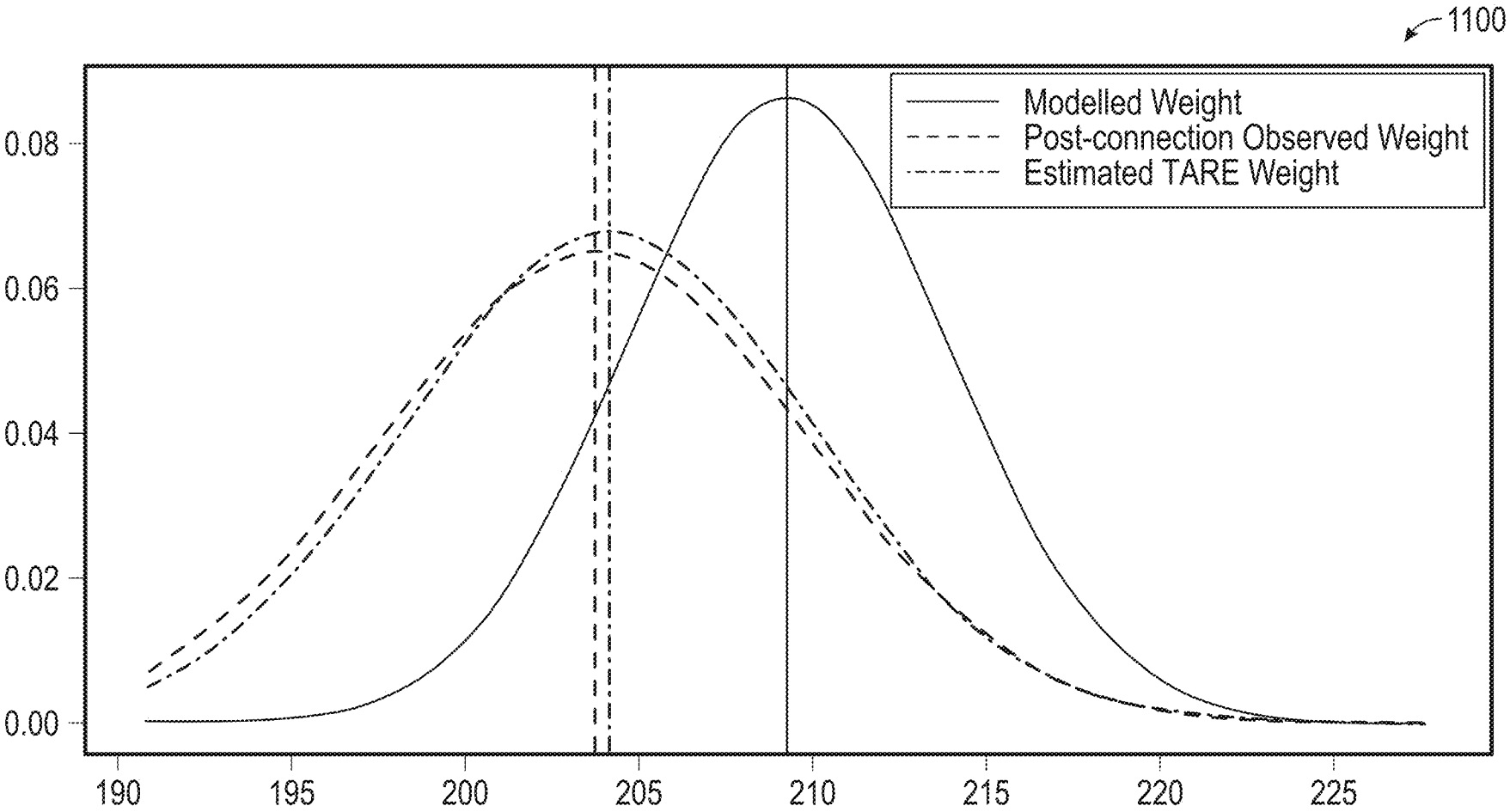
FIG. 11 illustrates an example of a graphical user interface.

FIG. 11 shows an example of a GUI 1100 that illustrates output from combining a prediction with an observation (e.g., a measurement) using a Gaussian update to estimate the TARE value at a particular depth (e.g., depth=6000 ft). As shown in the GUI 1100, the modeled or predicted weight Gaussian with a peak at approximately 209 may differ from the observed or measured weight post-connection Gaussian with a peak at approximately 203.5 where, for example, the estimated TARE weight Gaussian may be shifted to be between those two, for example, to have a peak at approximately 204. In such an approach, a framework may provide for improved TARE weight estimation, which may be performed automatically, based on one or more of a modeled or predicted value and an observed or measured value.

As an example, a framework may provide for combining a prediction (e.g., a model-based value) and a measurement (e.g., an observed value) with a Gaussian update through a Bayesian type of filter. In various instances, the challenge of combining a measurement with a prediction may be impacted by the prediction having a high uncertainty at times because a prediction model (e.g., GPRM) may be dense and also incomplete. In such instances, a Bayesian update can help in mitigating the uncertainty of the prediction model with observation data as may be generated via one or more sensors.

In various instances, measurements may be sparse as they may be contingent on attempts to infer a state (or states) from a sequence of operations, which may not be guaranteed to happen for each stand of drill pipe such that a post-connection observation of off bottom rotating weight may not be available. In these cases, a Bayesian update may rely on a data-driven model to fill the gap for that stand and still provide a reliable estimate of the TARE value.

Figure 12:
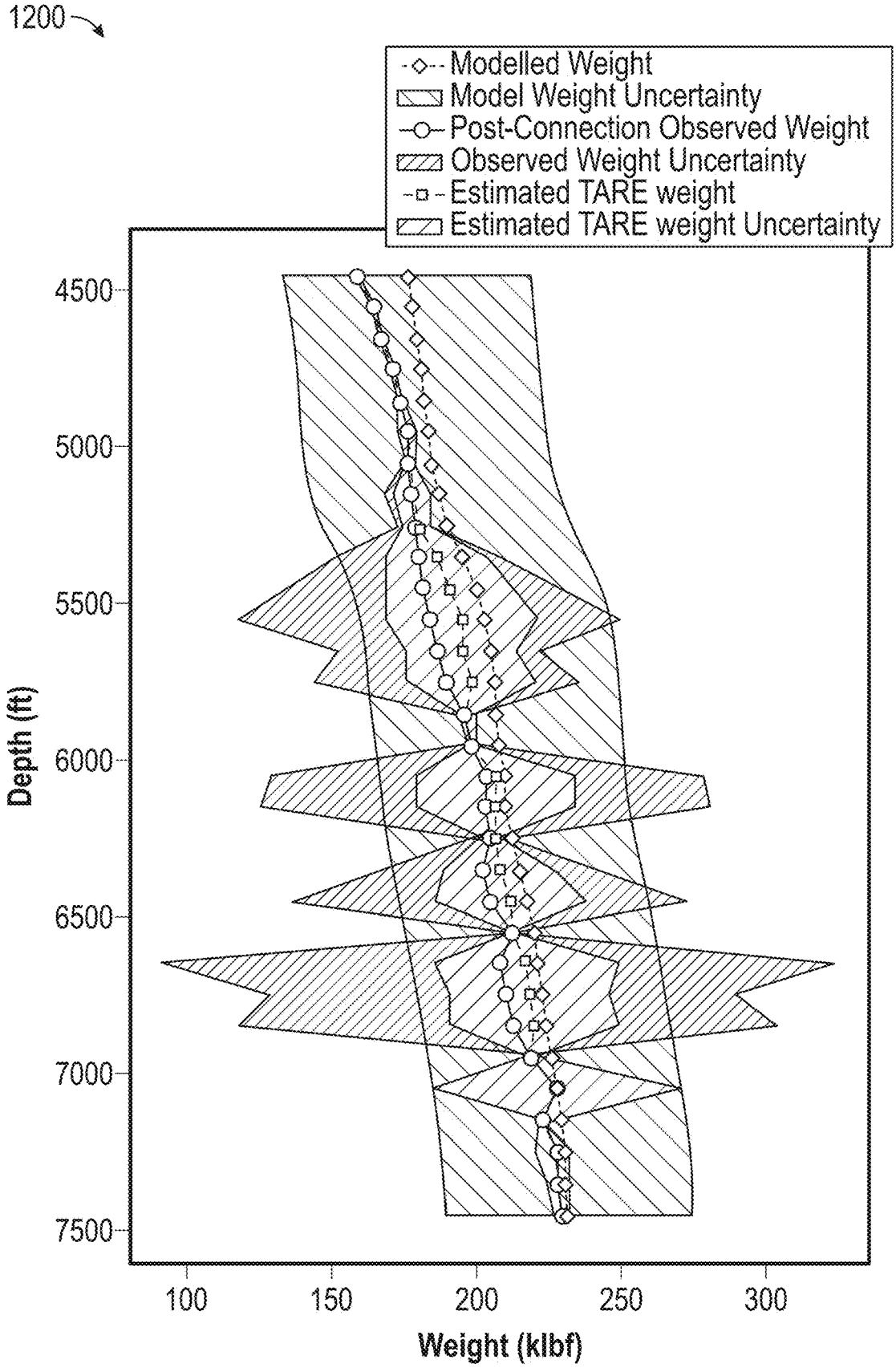
FIG. 12 illustrates an example of a graphical user interface.

FIG. 12 shows an example of a GUI 1200 where the GUI 1200 includes values for modeled weight (e.g., predicted weight), model weight uncertainty (e.g., predicted weight uncertainty), post-connection observed weight (e.g., post-connection measured weight), observed weight uncertainty (e.g., measured weight uncertainty), estimated TARE value, and estimated TARE value uncertainty. As shown, the estimated TARE value uncertainty is generally less than the model weight uncertainty and can be less than the observed weight uncertainty (e.g., measured weight uncertainty). As an example, prior knowledge of a state at each stand of drill pipe may be derived incorporating a state derived from off-bottom rotation pre-connection from a number of previous stands (e.g., one or more than one).

As an example, a framework may be implemented to generate estimated TARE values to improve TARE values utilized for one or more purposes during field operations, which may include drilling operation that may include drilling and/or tripping. As explained, a driller may utilize TARE values for understanding how drilling is being performed. As an example, where drilling is at least in part automated using one or more controllers, performance thereof may be improved via improved drilling and/or more autonomous drilling. As to automation, the ability to provide output as to uncertainty may be implemented in determining what level of automation to implement. For example, if uncertainty is above a threshold, a level of automation may be reduced, for example, to include more human involvement (e.g., a human-in-the-loop (HITL)); noting that upon a reduction in uncertainty, a level of automation may optionally be increased.

As explained, a framework may provide for computing more accurate TARE values for a number of stands of drill pipe using a measurement as well as a prediction from a data-driven model by combining the measurement and the prediction through a Bayesian update mechanism to thereby provide a way to determine TARE values with reduced uncertainty from sparse and partially observed post-connection procedures and a model as demonstrated. An estimated TARE value with its uncertainty may be rendered as a GUI to a display along with measured weight in a post-connection procedure and a predicted weight from a data-driven model.

As an example, a framework may provide for assessing one or more measurements, which, as explained, may include uncertainty due to state (e.g., temporal uncertainty) and/or uncertainty due to measurement noise (e.g., sensor-based noise). As an example, where a measurement and a prediction are not in agreement, a framework may provide feedback as to the measurement, which may include calling for slowing operations down to reduce temporal uncertainty as to state (e.g., a post-connection state) and/or calling for investigation of a sensor and/or data acquisition equipment. As an example, where agreement is deemed acceptable, a framework may call for speeding up operations as a post-connection state may be adequately detected with relatively little uncertainty where such detection may be taking more time that is necessary. In such an example, drilling operations may be improved by reducing non-productive time, lost invisible time, etc. As an example, a framework may provide for outputting an optimal window in which to acquire a post-connection hook load measurement as may correspond to a state where a drillstring is rotating and off bottom while drilling fluid is circulating (e.g., pumps on). In such an approach, drilling operations may be improved at least in part by reducing demands on a driller in deciding when to acquire a post-connection hook load value for use in taring (e.g., zeroing) a WOB gauge, etc.

Figure 13:
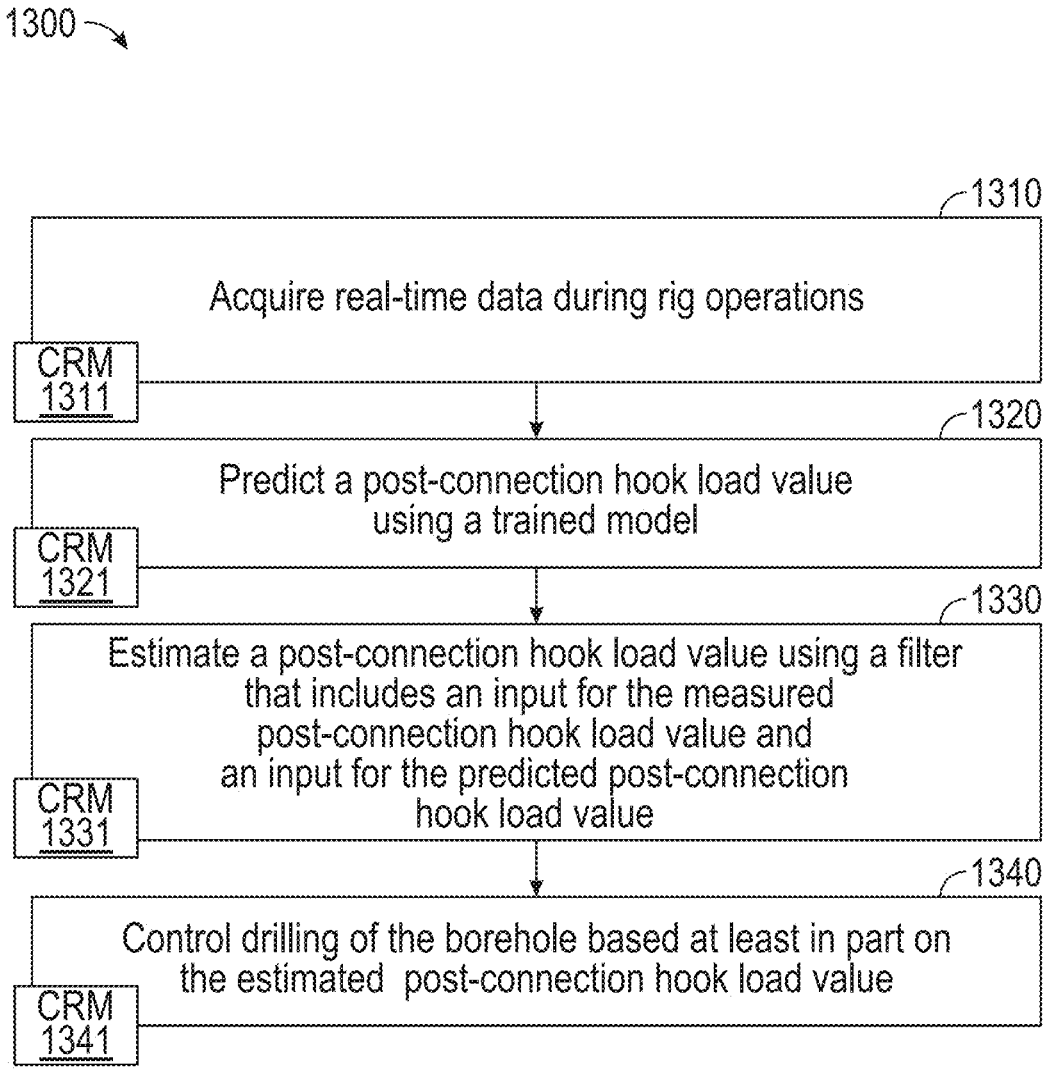
FIG. 13 illustrates an example of a method and an example of a system.
Figure 13:
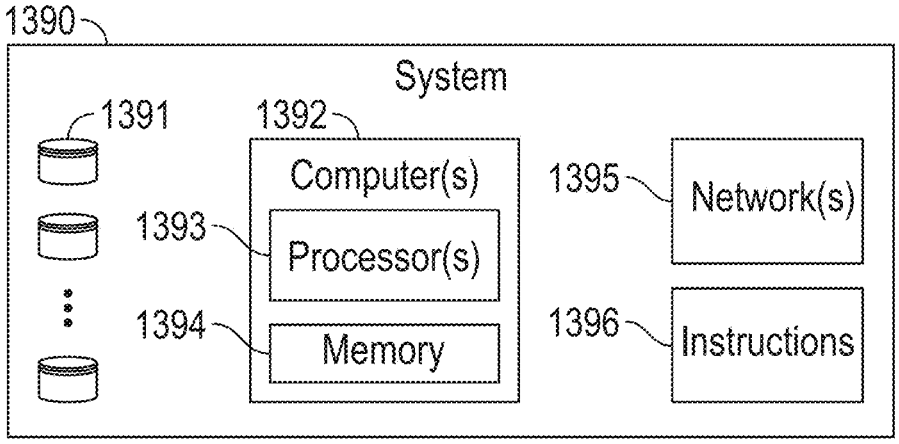

FIG. 13 shows an example of a method 1300 that includes an acquisition block 1310 for acquiring real-time data during rig operations that include rig operations for drilling a borehole in a subsurface geologic region using a drillstring that includes a drill bit, where the drillstring includes connected stands of drill pipe, and where the real-time data include a measured post-connection hook load value; a prediction block 1320 for predicting a post-connection hook load value using a trained model; an estimation block 1330 for estimating a post-connection hook load value using a filter that includes an input for the measured post-connection hook load value and an input for the predicted post-connection hook load value; and a control block 1340 for controlling drilling of the borehole based at least in part on the estimated post-connection hook load value.

FIG. 13 also shows various computer-readable media (CRM) blocks 1311, 1321, 1331, and 1341. Such blocks may include instructions that are executable by one or more processors, which may be one or more processors of a computational framework, a system, a computer, etc. A computer-readable medium may be a computer-readable storage medium that is not a signal, not a carrier wave and that is non-transitory. For example, a computer-readable medium may be a physical memory component that may store information in a digital format.

In the example of FIG. 13, a system 1390 includes one or more information storage devices 1391, one or more computers 1392, one or more networks 1395 and instructions 1396. As to the one or more computers 1392, each computer may include one or more processors (e.g., or processing cores) 1393 and memory 1394 for storing the instructions 1396, for example, executable by at least one of the one or more processors. As an example, a computer may include one or more network interfaces (e.g., wired or wireless), one or more graphics cards, a display interface (e.g., wired or wireless), etc. The system 1390 may be specially configured to perform one or more portions of the method 1300 of FIG. 13.

As to types of machine learning models, consider one or more of a support vector machine (SVM) model, a k-nearest neighbors (KNN) model, an ensemble classifier model, a neural network (NN) model, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, clastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average one-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model (ML model), may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, the TENSORFLOW framework (Google LLC, Mountain View, CA) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a method may include acquiring real-time data during rig operations that include rig operations for drilling a borehole in a subsurface geologic region using a drillstring that includes a drill bit, where the drillstring includes connected stands of drill pipe, and where the real-time data include a measured post-connection hook load value; predicting a post-connection hook load value using a trained model; estimating a post-connection hook load value using a filter that includes an input for the measured post-connection hook load value and an input for the predicted post-connection hook load value; and controlling drilling of the borehole based at least in part on the estimated post-connection hook load value. In such an example, the estimated post-connection hook load value may be utilized as a tare value.

As an example, a measured post-connection hook load value may include temporal uncertainty as to a rig state, for example, consider a rig state that may be an off bottom, free rotating state of the drillstring. In such an example, the rig state may further correspond to a circulation state, for example, where drilling fluid (e.g., mud) is circulating in a borehole. As an example, a measured post-connection hook load value may include sensor-based measurement noise.

As an example, a trained model may be or include a Gaussian Process model. For example, consider a Gaussian Process model that is or includes a Gaussian Process Regression model.

As an example, a trained model may include inputs for measured depth, inclination and mud density (e.g., drilling fluid density).

As an example, a method may include training a model to generate a trained model where the training includes accessing data for offset wells offset from a rig site of rig operations.

As an example, a method may include predicting that includes predicting uncertainty of a predicted post-connection hook load value.

As an example, a method may include implementing a filter, which may be or include a Bayesian type of filter. As an example, a filter may be or include a Kalman filter where, for example, the Kalman filter is or includes a Bayesian Kalman filter.

As an example, a method may include generating a graphical user interface that includes indicators of uncertainty of at least the estimated post-connection hook load value.

As an example, a post-connection hook load value may correspond to an operation that adds a stand of drill pipe to a drillstring. In such an example, a method may include controlling drilling that includes lowering a drillstring to contact a drill bit with a bottom of a borehole while the drill bit is rotating. In such an example, controlling drilling may include controlling weight on the drill bit based at least in part on an estimated post-connection hook load value, which may be, for example, a tare value.

As an example, a system can include a processor; memory accessible by the processor; processor-executable instructions stored in the memory and executable to instruct the system to: acquire real-time data during rig operations that include rig operations for drilling a borehole in a subsurface geologic region using a drillstring that includes a drill bit, where the drillstring includes connected stands of drill pipe, and where the real-time data include a measured post-connection hook load value; predict a post-connection hook load value using a trained model; estimate a post-connection hook load value using a filter that includes an input for the measured post-connection hook load value and an input for the predicted post-connection hook load value; and control drilling of the borehole based at least in part on the estimated post-connection hook load value.

As an example, one or more computer-readable storage media may include processor-executable instructions to instruct a computing system to: acquire real-time data during rig operations that include rig operations for drilling a borehole in a subsurface geologic region using a drillstring that includes a drill bit, where the drillstring includes connected stands of drill pipe, and where the real-time data include a measured post-connection hook load value; predict a post-connection hook load value using a trained model; estimate a post-connection hook load value using a filter that includes an input for the measured post-connection hook load value and an input for the predicted post-connection hook load value; and control drilling of the borehole based at least in part on the estimated post-connection hook load value.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave. As an example, a computer-program product may include instructions suitable for execution by one or more processors (or processor cores) where the instructions may be executed to implement at least a portion of a method or methods.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 14:
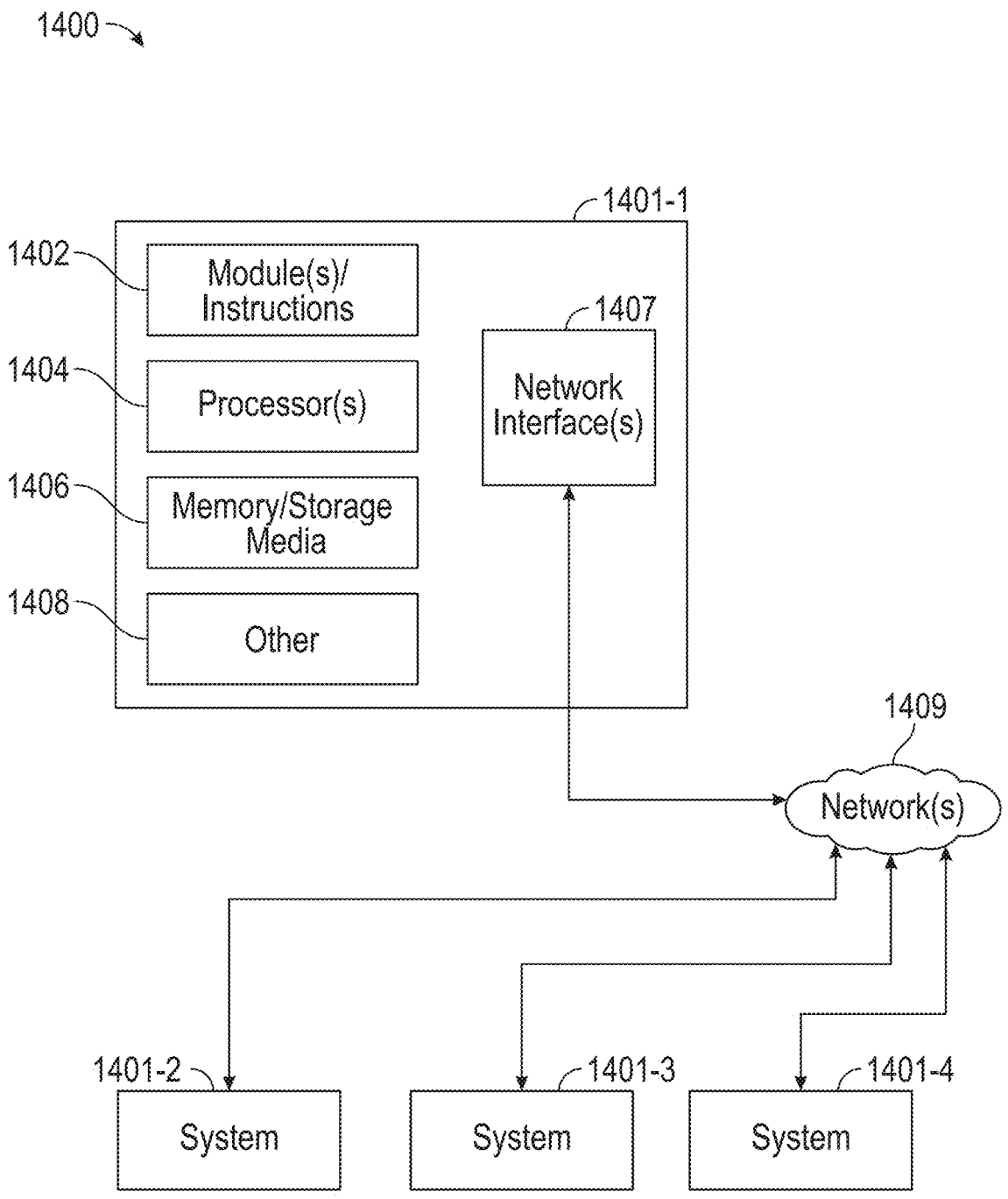
FIG. 14 illustrates an example of a computing system.

In some embodiments, a method or methods may be executed by a computing system. FIG. 14 shows an example of a system 1400 that may include one or more computing systems 1401-1, 1401-2, 1401-3 and 1401-4, which may be operatively coupled via one or more networks 1409, which may include wired and/or wireless networks.

As an example, a system may include an individual computer system or an arrangement of distributed computer systems. In the example of FIG. 14, the computer system 1401-1 may include one or more modules 1402, which may be or include processor-executable instructions, for example, executable to perform various tasks (e.g., receiving information, requesting information, processing information, simulation, outputting information, etc.).

As an example, a module may be executed independently, or in coordination with, one or more processors 1404, which is (or are) operatively coupled to one or more storage media 1406 (e.g., via wire, wirelessly, etc.). As an example, one or more of the one or more processors 1404 may be operatively coupled to at least one of one or more network interface 1407. In such an example, the computer system 1401-1 may transmit and/or receive information, for example, via the one or more networks 1409 (e.g., consider one or more of the Internet, a private network, a cellular network, a satellite network, etc.). As shown, one or more other components 1408 may be included in the computer system 1401-1.

As an example, the computer system 1401-1 may receive from and/or transmit information to one or more other devices, which may be or include, for example, one or more of the computer systems 1401-2, etc. A device may be located in a physical location that differs from that of the computer system 1401-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1406 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICS, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

acquiring real-time data during rig operations that comprise rig operations for drilling a borehole in a subsurface geologic region using a drillstring that comprises a drill bit, wherein the drillstring comprises connected stands of drill pipe, and wherein the real-time data comprises a measured post-connection hook load value;

predicting a post-connection hook load value using a trained model;

estimating a post-connection hook load value using a Kalman filter that comprises i) an input for the measured post-connection hook load value and ii) an input for the predicted post-connection hook load value and iii) an output representing the estimated post-connection hook load; and controlling drilling of the borehole based at least in part on the estimated post-connection hook load value, wherein the controlling drilling comprises lowering the drillstring to contact the drill bit with a bottom of the borehole while the drill bit is rotating, wherein the predicted post-connection hook load value comprises model uncertainty, and wherein uncertainty in the estimated post-connection hook load output from the Kalman filter is less than the model uncertainty.

2. The method of claim 1, wherein the estimated post-connection hook load value is utilized as a tare value.

3. The method of claim 1, wherein the measured post-connection hook load value comprises observed uncertainty that includes temporal uncertainty as to a rig state, and wherein the uncertainty in the estimated post-connection hook load output from the filter is less than the observed uncertainty.

4. The method of claim 3, wherein the rig state comprises an off bottom, free rotating state of the drillstring.

5. The method of claim 4, wherein the rig state further comprises a circulation state wherein drilling fluid is circulating in the borehole.

6. The method of claim 3, wherein the observed uncertainty further includes sensor uncertainty due to sensor-based measurement noise.

7. The method of claim 1, wherein the trained model comprises a Gaussian Process model.

8. The method of claim 7, wherein the Gaussian Process model comprises a Gaussian Process Regression model.

9. The method of claim 1, wherein the trained model comprises inputs for measured depth, inclination and mud density as well as an output for the predicted post-connection hook load, wherein the output represents an off bottom rotating weight for the drillstring with drilling fluid circulating in the borehole.

10. The method of claim 1, comprising training a model to generate the trained model wherein the training comprises accessing data for offset wells offset from a rig site of the rig operations.

11. The method of claim 1, wherein the Kalman filter includes a prediction process and an update process for output of a state estimate as well as feedback for the prediction process in a subsequent iteration, wherein the prediction process is configured to predict a post-connection hook load value along with uncertainty.

12. The method of claim 1, wherein the Kalman filter comprises a Bayesian Kalman filter.

13. The method of claim 1, comprising generating a graphical user interface that comprises at least one indicator of the uncertainty in the estimated post-connection hook load as a function of depth in the borehole.

14. The method of claim 1, wherein the measured post-connection hook load value corresponds to an operation that adds a stand of drill pipe to the drillstring and the output of the filter represents the estimated post-connection hook load for the stand of drill pipe added to the drillstring.

15. The method of claim 1, wherein the controlling drilling further comprises controlling weight on the drill bit based at least in part on the estimated post-connection hook load value.

16. The method of claim 1, wherein the rig operations use slips assembly configured to selectively engage and release the drillstring, and an operation corresponding to the measured post-connection hook load value involves the drillstring being released by the slips assembly and a downhole tool being lowered to be at a bottom hole location in the borehole.

17. A system comprising:

a processor;

memory accessible by the processor; and processor-executable instructions stored in the memory and executable to instruct the system to:

acquire real-time data during rig operations that comprise rig operations for drilling a borehole in a subsurface geologic region using a drillstring that comprises a drill bit, wherein the drillstring comprises connected stands of drill pipe, and wherein the real-time data comprises a measured post-connection hook load value;

predict a post-connection hook load value using a trained model;

estimate a post-connection hook load value using a Kalman filter that comprises i) an input for the measured post-connection hook load value and ii) an input for the predicted post-connection hook load value and iii) an output representing the estimated post-connection hook load; and control drilling of the borehole based at least in part on the estimated post-connection hook load value, wherein the control involves lowering the drillstring to contact the drill bit with a bottom of the borehole while the drill bit is rotating, wherein the predicted post-connection hook load value comprises model uncertainty, and wherein uncertainty in the estimated post-connection hook load output from the Kalman filter is less than the model uncertainty.

18. One or more computer-readable storage media comprising processor-executable instructions to instruct a computing system to:

acquire real-time data during rig operations that comprise rig operations for drilling a borehole in a subsurface geologic region using a drillstring that comprises a drill bit, wherein the drillstring comprises connected stands of drill pipe, and wherein the real-time data comprises a measured post-connection hook load value;

predict a post-connection hook load value using a trained model;

estimate a post-connection hook load value using a Kalman filter that comprises i) an input for the measured post-connection hook load value and ii) an input for the predicted post-connection hook load value and iii) an output representing the estimated post-connection hook load; and control drilling of the borehole based at least in part on the estimated post-connection hook load value, wherein the control involves lowering the drillstring to contact the drill bit with a bottom of the borehole while the drill bit is rotating, wherein the predicted post-connection hook load value comprises model uncertainty, and wherein uncertainty in the estimated post-connection hook load output from the Kalman filter is less than the model uncertainty.

* * * * *